US009182770B2

(12) United States Patent
Groeneweg et al.

(10) Patent No.: US 9,182,770 B2
(45) Date of Patent: Nov. 10, 2015

(54) VOLTAGE REGULATOR

(71) Applicant: ST-Ericsson SA, Plan-les-Ouates (CH)

(72) Inventors: Willem Groeneweg, Bremgarten (CH); Nedyalko Slavov, Zurich (CH)

(73) Assignee: ST-Ericsson SA, Plan-les-Ouates (CH)

( * ) Notice: Subject to any disclaimer, the term of this patent is extended or adjusted under 35 U.S.C. 154(b) by 407 days.

(21) Appl. No.: 13/632,358

(22) Filed: Oct. 1, 2012

(65) Prior Publication Data

US 2013/0027010 A1 Jan. 31, 2013

Related U.S. Application Data

(63) Continuation-in-part of application No. PCT/EP2011/055047, filed on Mar. 31, 2011.

(60) Provisional application No. 61/325,887, filed on Apr. 20, 2010.

(30) Foreign Application Priority Data

Apr. 1, 2010 (EP) ..... 10250718

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC ..... G05F 1/575; G05F 1/46; G05F 1/56; G05F 1/563; G05F 1/565; H03F 1/083; H03F 1/086; H03F 1/26
USPC ..... 323/269–277, 279–281, 312–317
See application file for complete search history.

(56) References Cited

U.S. PATENT DOCUMENTS

| | | | | |
|---|---|---|---|---|
| 5,986,507 | A * | 11/1999 | Itakura et al. | 330/288 |
| 7,982,448 | B1 * | 7/2011 | Prasad et al. | 323/315 |
| 8,026,703 | B1 * | 9/2011 | Damaraju et al. | 323/275 |
| 8,289,009 | B1 * | 10/2012 | Strik et al. | 323/272 |
| 8,570,098 | B2 * | 10/2013 | Jinbo | 327/540 |
| 2007/0272988 | A1 * | 11/2007 | Kwon et al. | 257/393 |
| 2008/0122415 | A1 | 5/2008 | Chou et al. | |
| 2008/0211581 | A1 * | 9/2008 | Su et al. | 330/260 |
| 2008/0284394 | A1 * | 11/2008 | Yin et al. | 323/282 |
| 2009/0189577 | A1 | 7/2009 | Lin et al. | |
| 2011/0001458 | A1 * | 1/2011 | Bansal et al. | 323/282 |
| 2011/0148324 | A1 * | 6/2011 | Du et al. | 315/297 |

OTHER PUBLICATIONS

EPO, Int'l Search Report in PCT/EP2011/055047, Apr. 26, 2011.

* cited by examiner

*Primary Examiner* — Timothy J Dole
*Assistant Examiner* — Ivan Laboy Andino
(74) *Attorney, Agent, or Firm* — Piedmont Intellectual Property

(57) ABSTRACT

A voltage regulator includes a current bridge and first and second current paths coupling a current mirror to respective first and second voltage-to-current converters. The current mirror controls a second current dependent on a first current. The first voltage-to-current converter controls the first current dependent on either a reference voltage or a feedback voltage derived from the regulator's output voltage, and the second voltage-to-current converter controls the second current dependent on the other of the feedback and reference voltages. Voltage-to-current conversion by the first converter is independent of voltage-to-current conversion by the second converter. An output transistor stage coupled to the second current path controls the output voltage dependent on the voltage in the second current path indicative of a deviation of the second current from a target current value dependent on the reference voltage.

24 Claims, 17 Drawing Sheets

VOLTAGE REGULATOR

This application is a continuation-in-part of International Application No. PCT/EP2011/055047 filed on Mar. 31, 2011, which claims the benefit of the filing date of U.S. Provisional Patent Application No. 61/325,887 filed on Apr. 20, 2010, and which claims priority to European Patent Application 10250718.3 filed on Apr. 1, 2010. Those three applications are incorporated in this application by reference.

TECHNICAL FIELD

The present disclosure relates to a voltage regulator and to a method of regulating an output voltage, and has application in, particularly but not exclusively, integrated circuits and power supply circuits for integrated circuits.

BACKGROUND

Low drop-out (LDO) voltage regulators are widely used to supply power to integrated circuits due to their ability to operate at a low voltage and their high power efficiency. An LDO voltage regulator is a voltage regulator which is able to regulate an output voltage to a predefined value with a very low difference between an input voltage and the output voltage. Such a voltage regulator may be embedded in an integrated circuit or may be provided externally.

A typical LDO voltage regulator known in the prior art comprises an output stage implemented as common source or common emitter transistor amplifier and an error amplifier arranged in a regulation loop which generates an error signal by comparing the output voltage to a reference voltage and which drives the output stage with the error signal.

An LDO voltage regulator 30 suitable for implementation in a Complementary Metal Oxide Semiconductor (CMOS) device is illustrated in FIG. 1. An input voltage $V_{DD}$ is supplied to a source of an output transistor 14, which is a p-channel metal oxide semiconductor field effect transistor (MOSFET), and the output voltage $V_{OUT}$ is delivered at a drain of the output transistor 14. Coupled between the drain of the output transistor 14 and a node, which may be a ground, are series coupled resistors $R_1$ and $R_2$. The junction of the series coupled resistors $R_1$, $R_2$ is coupled to a non-inverting input of an error amplifier 12. An inverting input of the error amplifier 12 is coupled to a reference voltage $V_{REF}$, and an output of the error amplifier 12 is coupled to a gate of the output transistor 14. The output voltage $V_{OUT}$ is delivered to a load, which is represented by a load resistive element $R_L$ coupled to the drain of the output transistor 14. In order to decouple the voltage regulator 30 from the load, a load capacitive element $C_L$ is coupled to the drain of the output transistor 14 in parallel with the load resistive element $R_L$. In order to ensure stability, a series coupled feedback capacitor $C_F$ and feedback resistor $R_F$ are coupled between the drain and a gate of the output transistor 14. The feedback capacitor $C_F$ can require a large silicon area for implementation in an integrated circuit. The load capacitive element $C_L$ can require an even larger silicon area, or can necessitate the use of an external discrete component. The use of an external discrete component can be undesirable due to the additional space required and parasitic components introduced by additional interconnections. Furthermore, the presence of the feedback capacitor $C_F$ can reduce the speed of operation of the voltage regulator 30, resulting in fast changes in the output voltage $V_{OUT}$ when fast changes occur in the current drawn by a load coupled to the output voltage $V_{OUT}$, such as can occur when parts of load circuits are switched on and off for power conservation. Fast changes in the output voltage $V_{OUT}$ can be reduced by means of filtering using a suitably large load capacitive element $C_L$, although the load capacitive element $C_L$ can also reduce the stability of the voltage regulator 30, which can oscillate if the load capacitive element $C_L$ is very large.

An alternative voltage regulator 40 known in the prior art is illustrated in FIG. 2. Its architecture differs from the architecture of the LDO voltage regulator 30 of FIG. 1 in two respects. First, its output stage comprises an n-channel MOSFET output transistor 16 with its drain coupled to the input voltage $V_{DD}$ and the output voltage $V_{OUT}$ delivered at its source. This configuration has improved stability, because the output transistor 16 normally doesn't introduce a dominant pole in the frequency range where the voltage regulator 40 has gain. Second, due to the improved stability, the feedback capacitor $C_F$ and feedback resistor $R_F$ of the LDO voltage regulator of FIG. 1 are omitted. However, the voltage regulator 40 of FIG. 2 is not an LDO voltage regulator. This is because the error amplifier 12 has to be capable of delivering at its output a voltage exceeding $V_{OUT}+V_{GS}$, where $V_{GS}$ is the gate-source threshold voltage of the output transistor 16 which is normally in the range 0.6 to 0.7 volts, and therefore the input voltage $V_{DD}$ must also exceed $V_{OUT}+V_{GS}$.

A further voltage regulator 50 known in the prior art is illustrated in FIG. 3. Its architecture differs from the architecture of the voltage regulator 40 of FIG. 2 by employing a charge pump 18 to convert the input voltage $V_{DD}$ to a higher voltage $V_H$, for example double the output voltage $V_{DD}$, by charging a storage capacitor $C_{Q2}$. The higher voltage $V_H$ is supplied to the error amplifier 12. This architecture can enable LDO operation. However, the storage capacitor $C_{Q2}$, and a pump capacitor $C_{Q1}$ required for the operation of the charge pump 18, can require a large silicon area for implementation in an integrated circuit, and the higher voltage $V_H$ may exceed the technological limits of modern sub-micron technologies. Also, this architecture can result in increased power consumption.

SUMMARY

According to a first aspect, there is provided a voltage regulator comprising:

a first input for a first input voltage;

a second input for a second input voltage lower than the first input voltage;

an output for an output voltage;

an output transistor stage having a first terminal coupled to a first one of the first and second inputs, a second terminal coupled to the output, and a control terminal for controlling the conductivity of the output transistor stage between the first terminal and the second terminal;

a feedback network coupled between the output and a second one of the first and second inputs, being different from the first one of the first and second inputs, and arranged to produce at a feedback node a feedback voltage dependent on the output voltage;

a first current path for conveying a first current and a second current path for conveying a second current;

a primary current mirror stage coupled to the first current path and to the second current path and arranged to control the second current dependent on the first current;

a first voltage-to-current converter coupled to the first current path and arranged to control the first current dependent on one of the feedback voltage and a reference voltage, and a second voltage-to-current converter coupled to the second current path and arranged to control the second current dependent on the other of the feedback voltage and the reference voltage, wherein the voltage-to-current conversion provided by the first voltage-to-current converter is independent of the voltage-to-current conversion provided by the second voltage-to-current converter; wherein the control terminal is coupled to the second current path for controlling the conductivity of the output transistor stage dependent on a voltage in the second current path indicative of a deviation of the second current from a target current value dependent on the reference voltage for thereby reducing a deviation of the output voltage from a target voltage value.

According to a second aspect, there is provided a method of regulating an output voltage, the method comprising:

producing a feedback voltage dependent on the output voltage;

controlling a first current in a first current path dependent on one of the feedback voltage and a reference voltage by means of a first voltage-to-current converter;

controlling a second current in a second current path dependent on the first current by means of a primary current mirror stage and controlling the second current dependent on the other of the feedback voltage and the reference voltage by means of a second voltage-to-current converter, wherein the voltage-to-current conversion provided by the first voltage-to-current converter is independent of the voltage-to-current conversion provided by the second voltage-to-current converter; and reducing a deviation of the output voltage from a target voltage value by controlling the output voltage dependent on a voltage in the second current path indicative of a deviation of the second current from a target current value dependent on the reference voltage.

The first current path and the second current path may be considered to be branches of a bridge circuit, with the current in one current path being dependent on the feedback voltage, and the current in the other current path being dependent on the reference voltage. Also, by means of the primary current mirror stage, the current in one path is a reflection of the current in the other path. The bridge will be balanced when the currents in the first and second current paths are matched, according to a current mirror ratio of the primary current mirror stage. The output voltage is controlled dependent on a voltage in the second current path, and will be at a target value when the bridge is balanced.

The voltage regulator according to the first aspect and the method of regulating an output voltage according to the second aspect are advantageous in the following respects:

LDO operation or non-LDO operation can be provided;

fast operation is enabled;

stable operation is enabled with a wide range of load current and load capacitance;

the load capacitive element $C_L$ can be dispensed with, or can be of reduced size;

the feedback capacitor $C_F$ and feedback resistor $R_F$ of the prior art illustrated in FIG. 1 can be dispensed with, enabling a stable voltage regulator to be implemented without capacitors, or they can be of reduced size;

the use of the charge pump 18, the pump capacitor $C_{Q1}$ and the storage capacitor $C_{Q2}$ of the prior art illustrated in FIG. 3 can be avoided; and a positive or negative output voltage can be provided.

Optionally, the first voltage-to-current converter can comprise a first transconductance amplifier having a first transconductance amplifier first input coupled to the second one of the first and second inputs via a first current sensing resistive element, a first transconductance amplifier second input arranged to receive the one of the feedback voltage and the reference voltage, and a first transconductance amplifier output coupled to control the conductivity of a first current converter transistor dependent on a difference between a voltage at the first transconductance amplifier first input and a voltage at the first transconductance amplifier second input, wherein the first current converter transistor is arranged to control the first current in the first current path, and the second voltage-to-current converter can comprise a second transconductance amplifier having a second transconductance amplifier first input coupled to the second one of the first and second inputs via a second current sensing resistive element, a second transconductance amplifier second input arranged to receive the other of the feedback voltage and the reference voltage, and a second transconductance amplifier output coupled to control the conductivity of a second current converter transistor dependent on a difference between a voltage at the second transconductance amplifier first input and a voltage at the second transconductance amplifier second input, wherein the second current converter transistor is arranged to control the second current in the second current path. Such voltage-to-current converters can enable fast operation of the voltage regulator.

Optionally, the one of the first and second inputs can be the first input and the other of the first and second inputs can be the second input, and the output transistor stage can comprise an output transistor having a p-channel, a source coupled to the first terminal, a drain coupled to the second terminal and a gate coupled to the control terminal. This embodiment enables LDO operation of the voltage regulator for a positive output voltage.

Optionally, the one of the first and second inputs can be the first input and the other of the first and second inputs can be the second input, and the output transistor stage can comprise an output transistor having an n-channel, a drain coupled to the first terminal, a source coupled to the second terminal and a gate coupled to the control terminal. This embodiment enables non-LDO operation of the voltage regulator for a positive output voltage.

Optionally, the one of the first and second inputs can be the second input and the other of the first and second inputs can be the first input, and the output transistor stage can comprise an output transistor having an n-channel, a source coupled to the first terminal, a drain coupled to the second terminal and a gate coupled to the control terminal. This embodiment enables LDO operation of the voltage regulator for a negative output voltage.

Optionally, the one of the first and second inputs can be the second input and the other of the first and second inputs can be the first input, and the output transistor stage can comprise an output transistor having a p-channel, a drain coupled to the first terminal, a source coupled to the second terminal and a gate coupled to the control terminal. This embodiment enables non-LDO operation of the voltage regulator for a negative output voltage.

Optionally, the first and second current converter transistors can each comprise an n-channel, the first transconductance amplifier first input and the second transconductance amplifier first input can be inverting inputs, and the first transconductance amplifier second input and the second transconductance amplifier second input can be non-inverting inputs. This embodiment enables regulation of a positive output voltage using n-channel transistors in the first and second voltage-to-current converters.

Optionally, the first and second current converter transistors can each comprise a p-channel, the first transconductance amplifier first input and the second transconductance amplifier first input can be inverting inputs, and the first transconductance amplifier second input and the second transconductance amplifier second input can be non-inverting inputs. This embodiment enables regulation of a negative output voltage using p-channel transistors in the first and second voltage-to-current converters.

Optionally, the first current sensing resistive element and the first current converter transistor can be arranged in the first current path and the second current sensing resistive element and the second current converter transistor can be arranged in the second current path. This embodiment enables a simple implementation.

Optionally, a first secondary current mirror stage can be coupled between the first current path and the first voltage-to-current converter for controlling the first current dependent on a reflection of a current in the first voltage-to-current converter, and a second secondary current mirror stage can be coupled between the second current path and the second voltage-to-current converter for controlling the second current dependent on a reflection of a current in the second voltage-to-current converter. Likewise, the method can comprise controlling the first current dependent on a reflection of a current in the first voltage-to-current converter, and controlling the second current dependent on a reflection of a current in the second voltage-to-current converter. This feature can provide a versatile architecture which enables the voltage regulator to be implemented using a plurality of identical cells according to the magnitude of a required output current.

Optionally, the first current path can comprise a plurality of first current sub-paths for each conveying a proportion of the first current, the second current path can comprise a plurality of second current sub-paths for each conveying a proportion of the second current, the primary current mirror stage can comprise a plurality of primary current mirror devices, the first secondary current mirror stage can comprise a plurality of first secondary current mirror devices coupled to respective ones of the primary current mirror devices by means of the respective first current sub-paths, the second secondary current mirror stage can comprise a plurality of second secondary current mirror devices coupled to respective ones of the primary current mirror devices by means of the respective second current sub-paths, and the output transistor stage can comprise a plurality of output transistors coupled between the first one of the first and second inputs and the output, wherein each of the output transistors is coupled to a different one of the second current sub-paths for controlling the conductivity of the respective output transistor between the first one of the first and second inputs and the output dependent on a voltage in the respective second current sub-path. Likewise, the method optionally can comprise conveying a proportion of the first current via each of a plurality of first current sub-paths and conveying a proportion of the second current via each of a plurality of second current sub-paths, and controlling, dependent on a voltage in the respective current sub-path, the conductivity of each of a plurality of output transistors coupled to a different one of the first or second current sub-paths. This feature can provide a versatile architecture which enables the voltage regulator to be implemented using a plurality of identical cells according to the magnitude of a required output current.

Optionally, the primary current mirror stage can be arranged to control the second current to be equal to the first current. Likewise, the method optionally can comprise controlling the second current to be equal to the first current. This feature can enable close matching of the first and second currents and also improved speed and stability.

Optionally, the primary current mirror stage can be arranged to control the second current to be greater than the first current. Likewise, the method optionally can comprise controlling the second current to be greater than the first current. This feature can enable power consumption of the voltage regulator to be reduced.

Optionally, the voltage regulator can comprise a differential amplifier stage coupled to the primary current mirror stage by means of a third current path for conveying a third current and by means of a fourth current path for conveying a fourth current, and coupled to the feedback network for receiving the feedback voltage, wherein the differential amplifier stage is arranged to control the third current dependent on the one of the feedback voltage and the reference voltage and to control the fourth current dependent on the other of the feedback voltage and the reference voltage, and wherein the primary current mirror stage is arranged to control the fourth current dependent on the third current. Likewise, the method optionally can comprise conveying a third current between a differential amplifier stage and the primary current mirror stage by means of a third current path, conveying a fourth current between the differential amplifier stage and the primary current mirror stage by means of a fourth current path, employing the differential amplifier stage to control the third current dependent on one of the feedback voltage the reference voltage and to control the fourth current dependent on the other of the feedback voltage and the reference voltage, and employing the primary current mirror stage to control the fourth current dependent on the third current. This feature can enable the voltage regulator to have a higher gain and bandwidth.

Optionally, the differential amplifier is arranged to control the third current to be smaller than the first current and the fourth current to be smaller than the second current by, for example, a factor of at least ten. This feature can contribute to the voltage regulator having a high stability and high phase margin.

Optionally, the voltage regulator can comprise a capacitive element coupled between the output and the feedback node. This feature can enable fast operation of the voltage regulator.

Optionally, the voltage regulator can comprise a capacitive element coupled between the output and one of the first and second inputs. This feature can decouple the voltage regulator from a load coupled to the output.

Optionally, the voltage regulator can be formed in an integrated circuit.

According to a further aspect there is provided an electronic apparatus comprising a voltage regulator according to the first aspect.

BRIEF DESCRIPTION OF THE DRAWINGS

Preferred embodiments will now be described, by way of example only, with reference to the accompanying drawings, in which.

DETAILED DESCRIPTION

Figure 1:
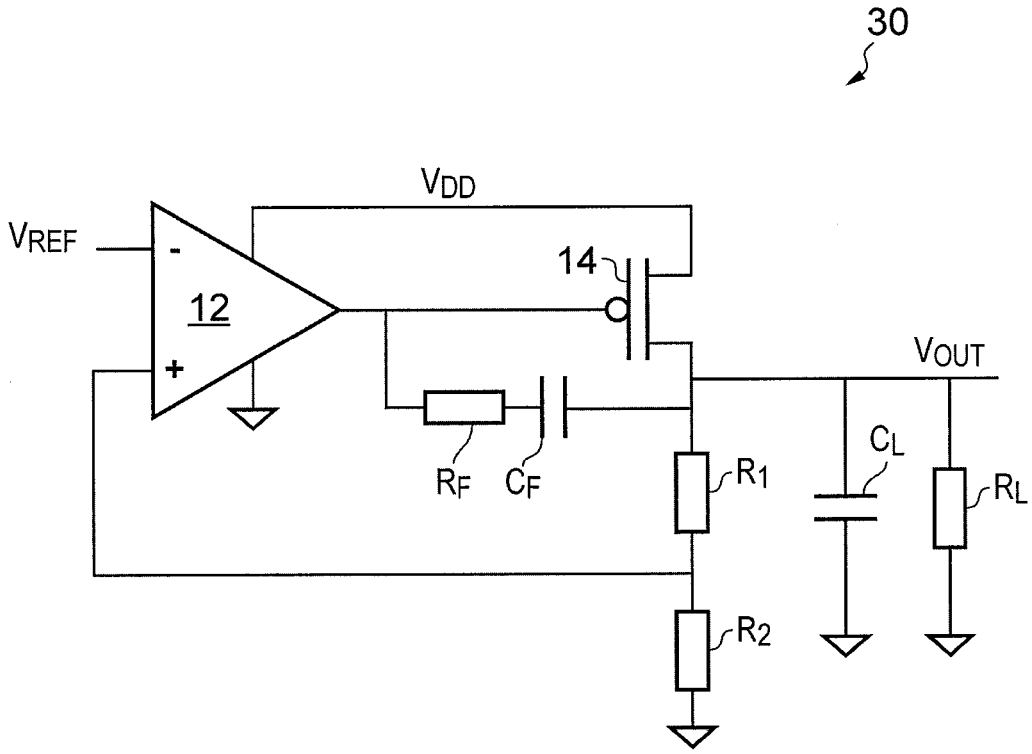
FIG. 1 (Prior Art)
FIG. 1 is a schematic diagram of a prior art voltage regulator.
Figure 2:
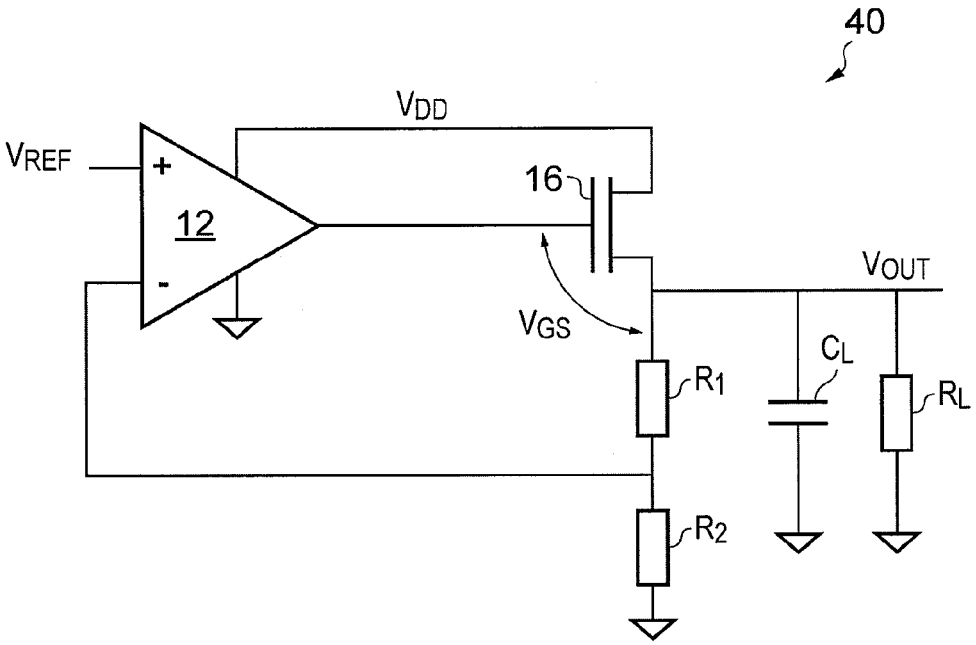
FIG. 2 (Prior Art)
FIG. 2 is a schematic diagram of a prior art voltage regulator.
Figure 3:
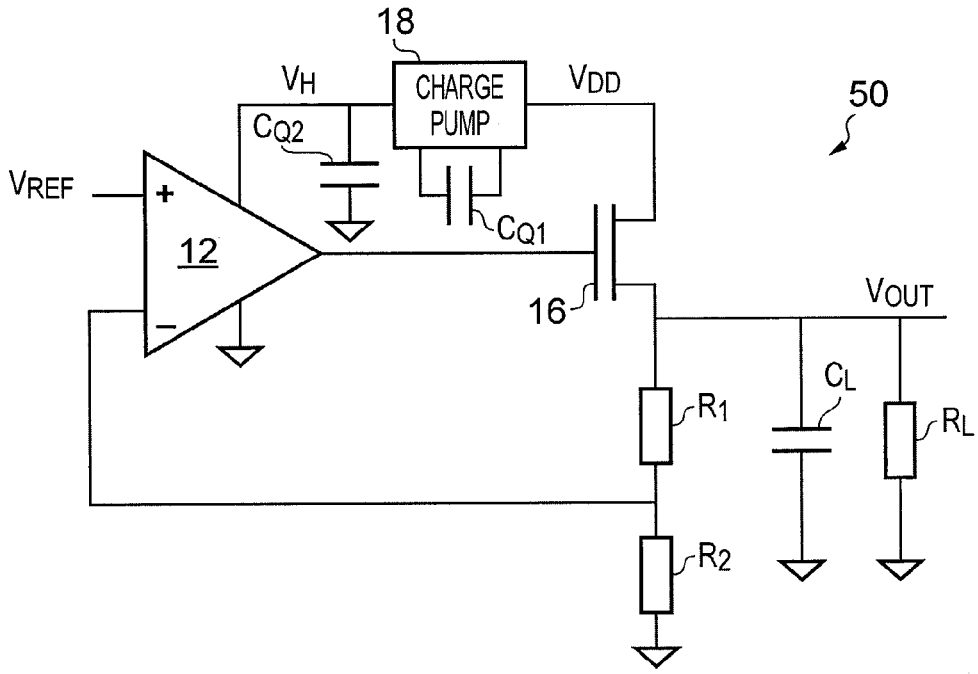
FIG. 3 (Prior Art)
FIG. 3 is a schematic diagram of a prior art voltage regulator.
Figure 4:
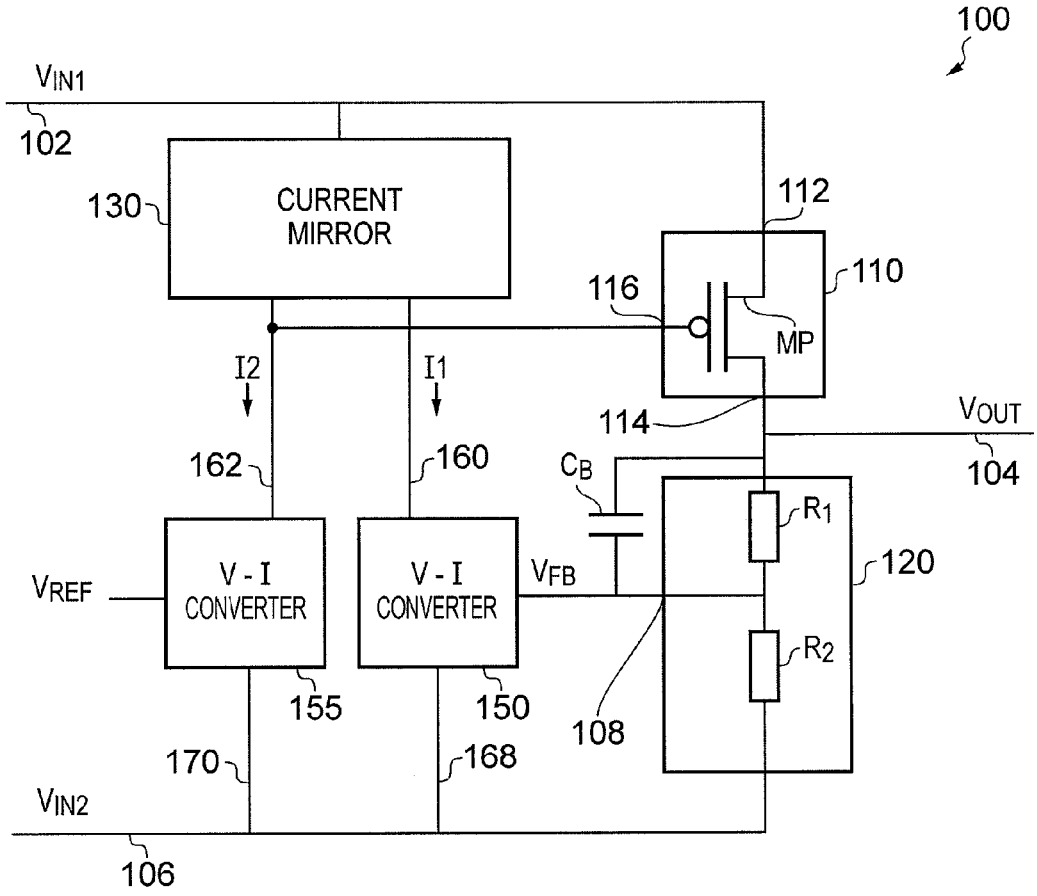
FIG. 4 is a schematic diagram of a voltage regulator in accordance with an embodiment of the invention.

Referring to FIG. 4, a voltage regulator 100 comprises a first input 102 for a first input voltage $V_{IN1}$, a second input 106 for a second input voltage $V_{IN2}$ lower than the first input voltage $V_{IN1}$, which may be a ground, and an output 104 for an output voltage $V_{OUT}$. An output transistor stage 110 has a first terminal 112 coupled to the input 102, a second terminal 114 coupled to the output 104, and a control terminal 116 for controlling the conductivity of the output transistor stage 110 between the first terminal 112 and the second terminal 114. The output transistor stage 110 illustrated in FIG. 4 comprises a p-channel output transistor MP which is a p-channel MOSFET in a common source configuration, having a source coupled to the first terminal 112, a drain coupled to the second terminal 114 and a gate coupled to the control terminal 116. This configuration can provide LDO operation.

Coupled to the output 104 of the voltage regulator 100 is a feedback network 120 arranged to produce a feedback voltage $V_{FB}$ dependent on the output voltage $V_{OUT}$. The feedback network 120 illustrated in FIG. 4 comprises feedback resistors $R_1$, $R_2$ coupled in series between the output 104 and the second input 106, thereby forming a voltage divider, although other arrangements of the feedback network 120 may be used. A junction between the feedback resistors $R_1$, $R_2$ is coupled to a feedback node 108 for delivering the feedback voltage $V_{FB}$. Coupled between the output 104 of the voltage regulator 100 and the feedback node 108 at which the feedback voltage $V_{FB}$ is delivered is an optional feedback capacitive element $C_B$, which can facilitate fast operation of the voltage regulator 100 by increasing gain at high frequencies.

The voltage regulator 100 comprises a first current path 160 for conveying a first current I1 and a second current path 162 for conveying a second current I2. There is a primary current mirror stage 130 coupled to the first current path 160 and to the second current path 162, and the primary current mirror stage 130 is arranged to control the second current I2 dependent on the first current I1 by mirroring the first current I1 such that the second current I2 is a reflection, or mirror, of the first current I1. More specifically, the second current I2 is related to the first current I1 by a current mirror ratio M, that is, I2=M·I1. The second current I2 may be controlled to be equal to the first current I1, in which case the value of the current mirror ratio M is one, or alternatively the second current I2 may be controlled to be greater than the first current I1, in which case the value of the current mirror ratio M is greater than one. The primary current mirror stage 130 is coupled to the first input 102 of the voltage regulator 100 for deriving power from the first input voltage $V_{IN1}$, although alternatively the primary current mirror stage 130 may be powered from a different supply.

A first voltage-to-current converter 150 is coupled to the first current path 160 and to the feedback node 108, and is arranged to control the first current I1 dependent on the feedback voltage $V_{FB}$. The first voltage-to-current converter 150 is also arranged to receive the second input voltage $V_{IN2}$ applied at the second input 106 by means of a first connection 168. The first connection 168 conveys the first current I1 controlled by the first voltage-to-current converter 150. A second voltage-to-current converter 155 is coupled to the second current path 162 and to a reference voltage $V_{REF}$, and is arranged to control the second current I2 dependent on the reference voltage $V_{REF}$. The reference voltage $V_{REF}$ can be provided by, for example, a band-gap device. The second voltage-to-current converter 155 is arranged to receive the second input voltage $V_{IN2}$ by means of a second connection 170. The second connection conveys the second current I2 controlled by the second voltage-to-current converter 155. The first and second connections 168, 170 are separate, that is they provide independent current paths. This enables the voltage-to-current conversion performed by the second voltage-to-current converter 155 to be independent of the voltage-to-current conversion performed by the first voltage-to-current converter 150. Nevertheless, because changes to the first current I1 resulting from changes in the feedback voltage $V_{FB}$ are reflected in the second current I2 by the primary current mirror stage 130, the control of the second current I2 due to the reference voltage $V_{REF}$ can be linearly superimposed on the changes in second current I2 due to the changes in the feedback voltage $V_{FB}$.

The control terminal 116 of the output transistor stage 110 is coupled to the second current path 162 for controlling the conductivity of the output transistor stage 110 between the first terminal 112 and the second terminal 114 dependent on a voltage in the second current path 162.

In operation, the primary current mirror stage 130, the first and second voltage-to-current converters 150, 155 and the first and second current paths 160, 162 form a current bridge. The bridge is balanced when the ratio of the second current I2 to the first current I1 is equal, or close, to the current mirror ratio M, and in this state the voltage in the first current path 160 between the primary current mirror stage 130 and the first voltage-to-current converter 150, and the voltage in the second current path 162 between the primary current mirror stage 130 and the second voltage-to-current converter 155, are equal, or similar. Also when the bridge is balanced, the second current I2 is at a target current value determined by the reference voltage $V_{REF}$, and the output voltage $V_{OUT}$ is stable at a target voltage value dependent on the reference voltage $V_{REF}$. If the output voltage $V_{OUT}$ deviates from the target voltage value, for example if an additional load begins to draw current from the output 104 of the voltage regulator 100, or a decreased load reduces the current drawn from the output 104 of the voltage regulator 100, the feedback voltage $V_{FB}$ will change. In response to the change in the feedback voltage $V_{FB}$, the first voltage-to-current converter 150 will operate to change the first current I1, thereby causing the current bridge to become unbalanced, meaning the ratio of the second current I2 to the first current I1 is no longer equal, or close, to the current mirror ratio M, and that the voltage in the first and second current paths 160, 162 is no longer equal, or similar. In response to the change in the first current I1, the primary current mirror stage 130 will operate to change the second current I2 to maintain the current mirror ratio M, and balance will be restored in the current bridge. For example, if the output voltage $V_{OUT}$ increases above the target voltage value, then the feedback voltage $V_{FB}$ will also increase, thereby causing the first current I1 to increase and the voltage in the first current path 160 to decrease. In response, the second current I2 will increase and the voltage in the second current path 162 will increase. Preferably the second voltage-to-current converter 155 has a high output resistance, thereby causing the second current I2 to change very little from the target current value determined by the reference voltage $V_{REF}$ despite a large change in the voltage in the second current path 162. In this case, when the primary current mirror stage 130 operates to increase or decrease the second current I2 by a small amount in response to a change in the first current I1, the voltage in second current path 162 will increase or decrease by a larger amount. In response to the increase in the voltage in the second current path 162, the voltage applied to the control terminal 116 of the output transistor stage 110 will increase, thereby decreasing the voltage between the gate and the source of the output transistor MP, and thereby decreasing the conductivity of the output transistor stage 110 and resulting in a decrease in the output voltage $V_{OUT}$. Alternatively, if the output voltage $V_{Out}$ decreases below the target value, then the feedback voltage $V_{FB}$ will also decrease, thereby causing the first current I1 to decrease and the voltage in the first current path 160 to increase. In response, the second current I2 will decrease and the voltage in the second current path 162 will decrease. In response to the decrease in the voltage in the second current path 162, the voltage applied to the control terminal 116 of the output transistor stage 110 will decrease, and the voltage between the gate and the source of the p-channel output transistor MP will increase, thereby increasing the conductivity of the output transistor stage 110, resulting in an increase in the output voltage $V_{OUT}$.

Figure 5:
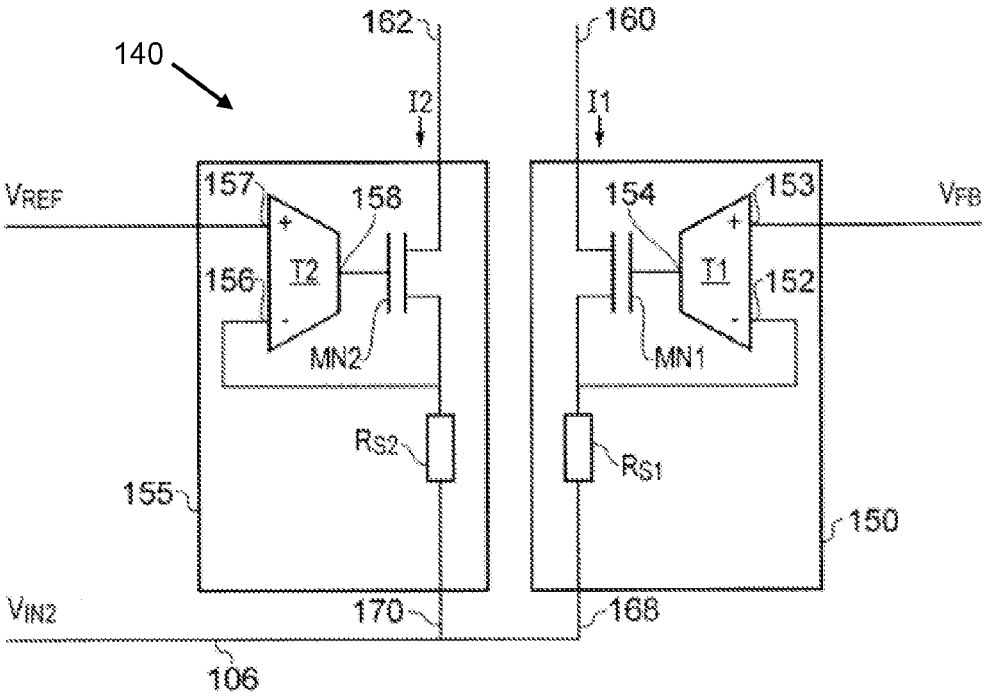
FIG. 5 is a schematic diagram of voltage-to-current converters.

An embodiment of the first voltage-to-current converter 150 and the second voltage-to-current converter 155 is illustrated in FIG. 5. Referring to FIG. 5, the first voltage-to-current converter 150 has an input for receiving the feedback voltage $V_{FB}$ from the feedback network 120, an input for coupling to the first current path 160 for receiving the first current I1, and an input for coupling to the second input 106 via the first connection 168 for receiving the second input voltage $V_{IN2}$. The first voltage-to-current converter 150 comprises a first transconductance amplifier T1 having a first inverting input 152 coupled to the second input 106 via a first current sensing resistor $R_{S1}$, a first non-inverting input 153 for coupling to the feedback node 108 for receiving the feedback voltage $V_{FB}$, and a first output 154 coupled to a first current converter transistor MN1 for controlling the conductivity of the first current converter transistor MN1. The first current converter transistor MN1 is coupled between the first current path 160 and the first current sensing resistor $R_{S1}$. The first current I1 passes through the first current converter transistor MN1, the first current sensing resistor $R_{S1}$, and the first connection 168.

Continuing to refer to FIG. 5, the second voltage-to-current converter 155 has an input for receiving the reference voltage $V_{REF}$, an input for coupling to the second current path 162 for receiving the second current I2, and an input for coupling to the second input 106 via the second connection 170 for receiving the second input voltage $V_{IN2}$. The second voltage-to-current converter 155 comprises a second transconductance amplifier T2 having a second inverting input 156 coupled to the second input 106 via a second current sensing resistor $R_{S2}$, a second non-inverting input 157 for receiving the reference voltage $V_{REF}$, and a second output 158 coupled to a second current converter transistor MN2 for controlling the conductivity of the second current converter transistor MN2. The second current converter transistor MN2 is coupled between the second current path 162 and the second current sensing resistor $R_{S2}$. The second current I2 passes through the second current converter transistor MN2, the second current sensing resistor $R_{S2}$, and the second connection 170.

The first and second current converter transistors MN1, MN2 are n-channel metal oxide semiconductor (NMOS) transistors. The first and second transconductance amplifiers T1, T2 can each comprise a single stage amplifier, such as a differential amplifier with or without a folded cascode or another configuration implementing a differential input. Power supply connections to the first and second transconductance amplifiers T1, T2 are omitted from FIG. 5 for clarity.

In operation, first transconductance amplifier T1 compares the voltage on the first current sensing resistor $R_{S1}$, which is applied to the first inverting input 152 of the first transconductance amplifier T1, with the feedback voltage $V_{FB}$ applied to the first non-inverting input 153 of the first transconductance amplifier T1, and the voltage at the first output 154 of the first transconductance amplifier T1 resulting from the comparison is applied to a gate of the first current converter transistor MN1. In this way, the first transconductance amplifier T1 operates to align the voltage on the first current sensing resistor $R_{S1}$ with the feedback voltage $V_{FB}$, and in doing so controls the first current I1 which flows through the first current converter transistor MN1 and the first current sensing resistor $R_{S1}$.

The second transconductance amplifier T2 operates in a corresponding manner, comparing the voltage on the second current sensing resistor $R_{S2}$, which is applied to the second inverting input 156 of the second transconductance amplifier T2, with the reference voltage $V_{REF}$ applied to the second non-inverting input 157 of the second transconductance amplifier T2. The voltage at the second output 158 of the second transconductance amplifier T2 resulting from the comparison is applied to a gate of the second current converter transistor MN2. In this way, the second transconductance amplifier T2 operates to align the voltage on the second current sensing resistor $R_{S2}$ with the reference voltage $V_{REF}$, and in doing so controls the second current I2 which flows through the second current converter transistor MN2 and the second current sensing resistor $R_{S2}$. In this way, the first voltage-to-current converter 150 controls the first current I1 dependent on the feedback voltage $V_{FB}$, and the second voltage-to-current converter 155 controls the second current I2 dependent on the reference voltage $V_{REF}$. In particular, the voltage at the junction of the first current sensing resistor $R_{S1}$ and the first current converter transistor MN1, which is applied to the first transconductance amplifier T1, and the voltage at the junction of the second current sensing resistor $R_{S2}$ and the second current converter transistor MN2, which is applied to the second transconductance amplifier T2 can be different and can vary independently of each other. Other embodiments of the first voltage-to-current converter 150 and the second voltage-to-current converter 155 may alternatively be used.

Preferably the first and second current sensing resistors $R_{S1}$ and $R_{S2}$ are matched by being constructed using the same structure, for example poly-silicon pieces with the same size, and by locating them close to each other with the same orientation, although they need not have equal values of resistance. This can enable the first and second current sensing resistors $R_{S1}$ and $R_{S2}$ to have proportional resistance values and the same temperature dependence. In this way, any inaccuracy in the resistance values can be of the same proportion and in the same direction, thereby affecting both the first and second currents I1 and I2 in the same way. If any input voltage offset introduced by the first and second transconductance amplifiers T1, T2 is neglected, then the first current I1 can be expressed as $I1=(V_{OUT}\cdot R2)/((R1+R2)\cdot Rs1)$, where R1, R2 and $R_{S1}$ represent, respectively the resistance of the feedback resistors R1, R2 and the first current sensing resistor $R_{S1}$, and the second current I2 can be expressed as $I2=V_{REF}/R_{S2}$, where $R_{S2}$ represents the resistance of the second current sensing resistor $R_{S2}$. If the bridge formed by the primary current mirror stage 130, the current control stage 140 and the first and second current paths 160, 162 is balanced, then the output voltage $V_{OUT}$ is equal to the target voltage value and can be expressed as $V_{OUT}=V_{REF}\cdot(R1+R2)\cdot R_{S1}/M\cdot R2\cdot R_{S2}$, where M=I2/I1. If the current mirror ratio M is one, resulting in the first and second currents I1, I2 being equal, and if the first and second current sensing resistors $R_{S1}$, $R_{S2}$ are equal, then the target value of the feedback voltage $V_{FB}$ is equal to $V_{REF}$ and so the target value of the output voltage $V_{OUT}$ can be expressed as $V_{OUT}=V_{REF}\cdot(R1+R2)/R2$.

In the voltage regulator 100 illustrated in FIG. 4, the first current path 160 drives only the first voltage-to-current converter 150. In contrast, the second current path 162 drives the gate of the p-channel output transistor MP of the output transistor stage 110, in addition to delivering the second current I2 to the second voltage-to-current converter 155. Depending on the current to be drawn from the output 104 of the voltage regulator 100, the p-channel output transistor MP may be of such a size that it presents a significant capacitive load to the second current path 162. In this case, the second current I2 in the second current path 162 may need to have a high value in order for the voltage regulator 100 to operate at a sufficiently high speed. Therefore, in order to minimise power consumption, the first current I1 may be arranged to have a lower value than the second current I2, in which case the current mirror ratio M is greater than one.

Figure 6:
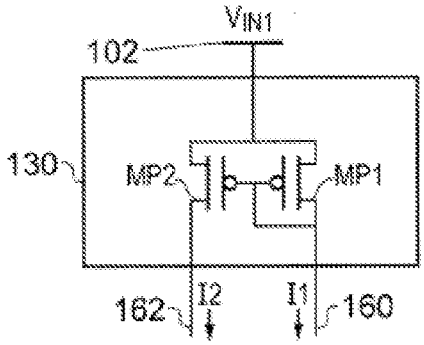
FIG. 6 is a schematic diagram of a primary current mirror stage.

An embodiment of the primary current mirror stage 130 is illustrated in FIG. 6, and comprises a first current mirror transistor MP1 and a second current mirror transistor MP2, these both being p-channel metal oxide semiconductor (PMOS) transistors. The first and second current mirror transistors MP1, MP2 have their sources coupled to the first input 102 for receiving the first input voltage $V_{IN1}$ and their gates coupled together, thereby establishing common operating conditions for the first and second current mirror transistors MP1, MP2. The first current mirror transistor MP1 has its drain coupled to the first current path 160 for delivering the first current I1, and its drain coupled to its gate for controlling the gate of both the first and second current mirror transistors MP1, MP2 with a common voltage. The second current mirror transistor MP2 has its drain coupled to the second current path 162 for delivering the second current I2 reflected from the first current I1. For a current mirror ratio M of one, the first and second current mirror transistors MP1, MP2 are of equal size, whereas for other values of the current mirror ratio, the first and second current mirror transistors MP1, MP2 can be of different sizes. Other embodiments of the primary current mirror stage 130 may alternatively be used.

Further embodiments of voltage regulators are described below which illustrate some of the variations that fall within the scope of the invention, including the provision of a positive or a negative output voltage, the use of n-channel or p-channel transistors, the use of LDO or non-LDO operation, the use of the first and second currents I1, I2 which flow either from the primary current mirror stage 130 to the first and second voltage-to-current converters 150, 155 or in the opposite direction, and the use of either the reference voltage $V_{REF}$ or the feedback voltage $V_{FB}$ by either of the first and second voltage-to-current converters 150, 155 to control respectively the first current I1 and the second current I2. Despite the variations employed in each of the embodiments of the voltage regulator, according to the terminology used throughout this description and the accompanying claims, for each embodiment the primary current mirror stage 130 controls the second current I2 in the second current path 162 to be a reflection of the first current I1 in the first current path 160, and the control terminal 116 of the output transistor stage 110 is in each embodiment coupled to the second current path 162 conveying the second current I2.

Figure 7:
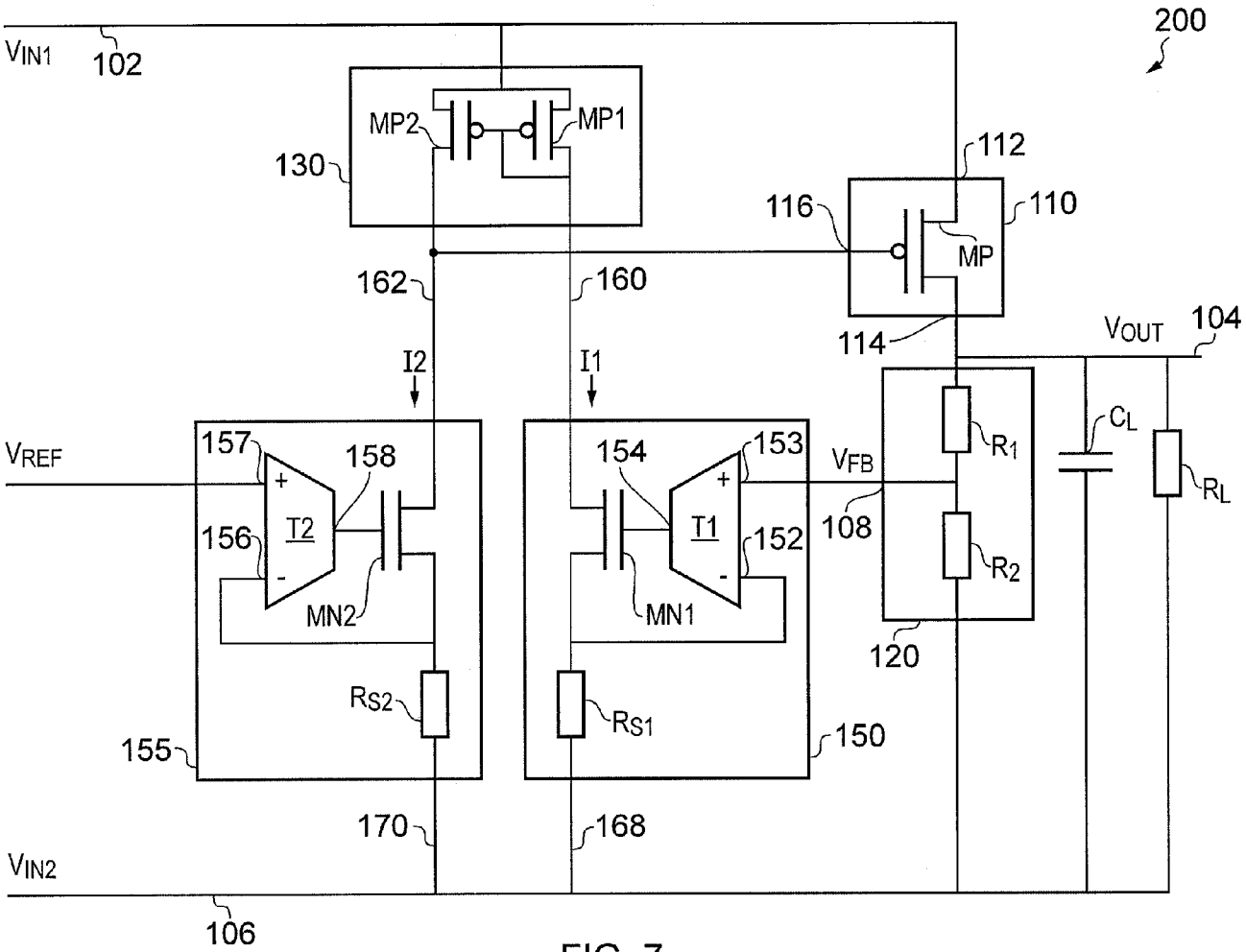
FIG. 7 is a schematic diagram of a voltage regulator for a positive voltage and LDO operation.

FIG. 7 illustrates a voltage regulator 200 having the same general architecture as the voltage regulator 100 illustrated in FIG. 4 and incorporating the embodiments of the first and second voltage-to-current converters 150, 155 illustrated in FIG. 5 and the primary current mirror stage 130 illustrated in FIG. 6. In FIG. 7 the optional feedback capacitive element $C_B$ has been omitted. Furthermore in FIG. 7, and correspondingly in FIGS. 8 to 12, 14 and 15 illustrating further embodiments, a load resistive element $R_L$ is coupled to the output 104 and, although not part of the voltage regulator 200, illustrates how a load is coupled to the voltage regulator 200. In FIG. 7 the load resistive element $R_L$ is coupled between the output 104 and the second input 106. An optional load capacitive element $C_L$ is coupled in parallel with the load resistive element $R_L$ for decoupling the voltage regulator 200 from the load resistive element $R_L$. The load capacitive element $C_L$ may be provided in an integrated circuit with the voltage regulator 200, or may be provided external to such an integrated circuit. A smaller load capacitive element $C_L$ may be employed with the voltage regulator according the invention than required with prior art voltage regulators, and therefore may be integrated with the voltage regulator where, in prior art voltage regulators, a discrete component was required.

Figure 8:
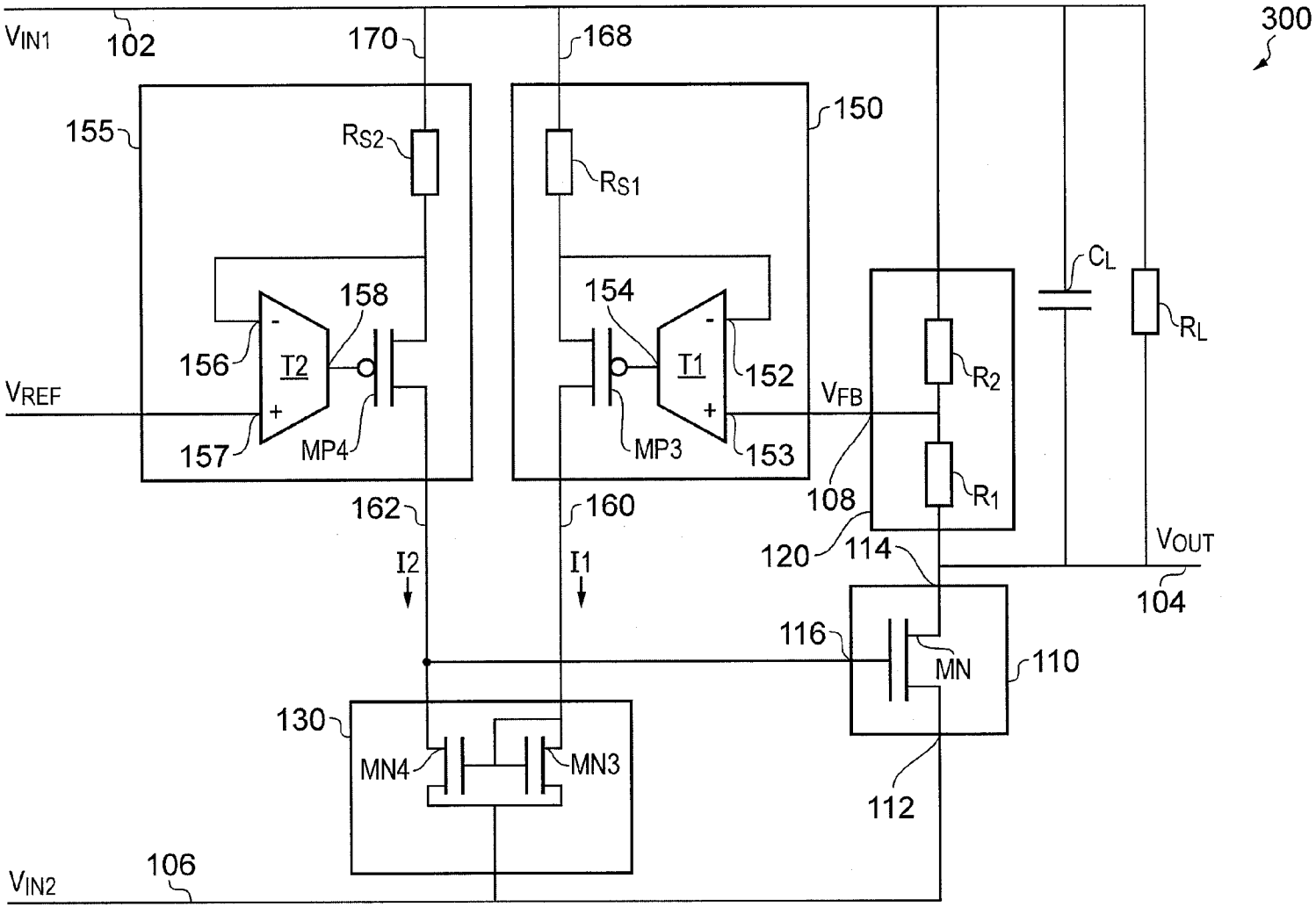
FIG. 8 is a schematic diagram of a voltage regulator for a negative voltage and LDO operation.

The voltage regulator 200 of FIG. 7 is suitable for delivering a positive output voltage $V_{OUT}$, for which the first input voltage $V_{IN1}$ can be positive and the second input voltage $V_{IN2}$ can be zero, for example a ground potential. FIG. 8 illustrates an embodiment of a voltage regulator 300 suitable for delivering a negative output voltage $V_{OUT}$ in which the first input voltage $V_{IN1}$ can be zero, for example a ground potential, and the second input voltage $V_{IN2}$ can be negative. The embodiment of FIG. 8 comprises the same elements as the embodiment of FIG. 7, namely the output stage 110, the feedback network 120, first and second voltage-to-current converters 150, 155 and the primary current mirror stage 130. Differences in the architecture and interconnection of these elements is described below.

Referring to FIG. 8, the output transistor stage 110 has its first terminal 112 coupled to the second input 106, its second terminal 114 coupled to the output 104, and its control terminal coupled to the second current path 162. The output stage 110 comprises an n-channel output transistor MN which is an n-channel MOSFET in a common source configuration, having a source coupled to the first terminal 112, a drain coupled to the second terminal 114, and a gate coupled to the control terminal 116. The feedback network 120 is coupled between the output 104 and the first input 102. The load resistive element $R_L$ is coupled between the output 104 and the first input 102. The optional load capacitive element $C_L$ is coupled in parallel with the load resistive element $R_L$.

The first transconductance amplifier T1 of the first voltage-to-current converter 150 in the embodiment of FIG. 8 has its first non-inverting input 153 arranged to receive the reference voltage $V_{FB}$ from the feedback node 108. The first inverting input 152 of the first transconductance amplifier T1 is coupled to the first input 102 via the first current sensing resistor $R_{S1}$, and its first output 154 coupled to a third current converter transistor MP3 for controlling the conductivity of the third current converter transistor MP3. The third current converter transistor MP3 is coupled between the first current path 160 and the first current sensing resistor $R_{S1}$. The first voltage-to-current converter 150 is arranged to receive the first input voltage $V_{IN1}$ applied at the first input 102 by means of the first connection 168. The first connection 168 conveys the first current I1 controlled by the first voltage-to-current converter 150. Therefore, the first current I1 passes through the third current converter transistor MP3, the first current sensing resistor $R_{S1}$ and the first connection 168.

Continuing to refer to FIG. 8, the second transconductance amplifier T2 of the second voltage-to-current converter 155 has its second non-inverting input 157 arranged to receive the reference voltage $V_{REF}$, its first inverting input 156 is coupled to the first input 102 via the second current sensing resistor $R_{S2}$, and its second output 158 is coupled to a fourth current converter transistor MP4 for controlling the conductivity of the fourth current converter transistor MP4. The fourth current converter transistor MP4 is coupled between the second current path 162 and the second current sensing resistor $R_{S2}$. The second voltage-to-current converter 155 is arranged to receive the first input voltage $V_{IN}$ applied at the first input 102 by means of the second connection 170. The second connection 170 conveys the second current I2 controlled by the second voltage-to-current converter 155. Therefore, the second current I2 passes through the fourth current converter transistor MP4, the second current sensing resistor $R_{S2}$ and the second connection 170. As in all embodiments, the first and second connections 168, 170 are separate, that is they provide independent current paths, enabling the voltage-to-current conversion performed by the second voltage-to-current converter 155 to be independent of the voltage-to-current conversion performed by the first voltage-to-current converter 150. Nevertheless, because changes to the first current I1 resulting from changes in the feedback voltage $V_{FB}$ are reflected in the second current I2 by the primary current mirror stage 130, the control of the second current I2 due to the reference voltage $V_{REF}$ can be linearly superimposed on the changes in second current I2 due to the changes in the feedback voltage $V_{FB}$. The third and fourth current converter transistors MP3, MP4, are PMOS transistors in contrast to the respective NMOS first and second current converter transistors MN1, MN2 in the embodiment of FIG. 7.

The primary current mirror stage 130 illustrated in FIG. 8 comprises a third current mirror transistor MN3 and a fourth current mirror transistor MN4, these both being NMOS transistors. The third and fourth current mirror transistors MN3, MN4 have their sources coupled to the second input 106 for receiving the second input voltage $V_{IN2}$ and their gates coupled together, thereby establishing common operating conditions for the third and fourth current mirror transistors MN3, MN4. The third current mirror transistor MN3 has its drain coupled to the first current path 160 for receiving the first current I1, and its drain coupled to its gate for controlling the gate of both the third and fourth current mirror transistors MN3, MN4 with a common voltage. The fourth current mirror transistor MN4 has its drain coupled to the second current path 162 for receiving the second current I2 reflected from the first current I1. In particular, the first current I1 and the second current I2 both flow from, respectively, the first and second voltage-to-current converters 150, 155 to the primary current mirror stage 130, rather than in the opposite direction as in the embodiment of FIG. 7. For a current mirror ratio M of one, the third and fourth current mirror transistors MN3, MN4 are of equal size, whereas for other values of the current mirror ratio, the third and fourth current mirror transistors MN3, MN4 can be of different sizes. The control terminal 116 of the output transistor stage 110 is coupled to the second current path 162. In operation, under quiescent conditions, the reference voltage $V_{REF}$ causes target values of the first and second currents I1, I2 to be established in, respectively, the first and second current paths 160, 162, and a target output voltage $V_{OUT}$ to be established at the output 104, with a corresponding target feedback voltage $V_{FB}$. Any subsequent deviation of the output voltage $V_{OUT}$ from the target voltage value, due to variation in the resistance of the load resistive element $R_L$ will result in a change to the feedback voltage $V_{FB}$ and to the first and second currents I1, I2, such that the voltage in the second current path 162 operates to control the output transistor stage 110 to cause the output voltage $V_{OUT}$ to be restored to the target voltage value.

Figure 9:
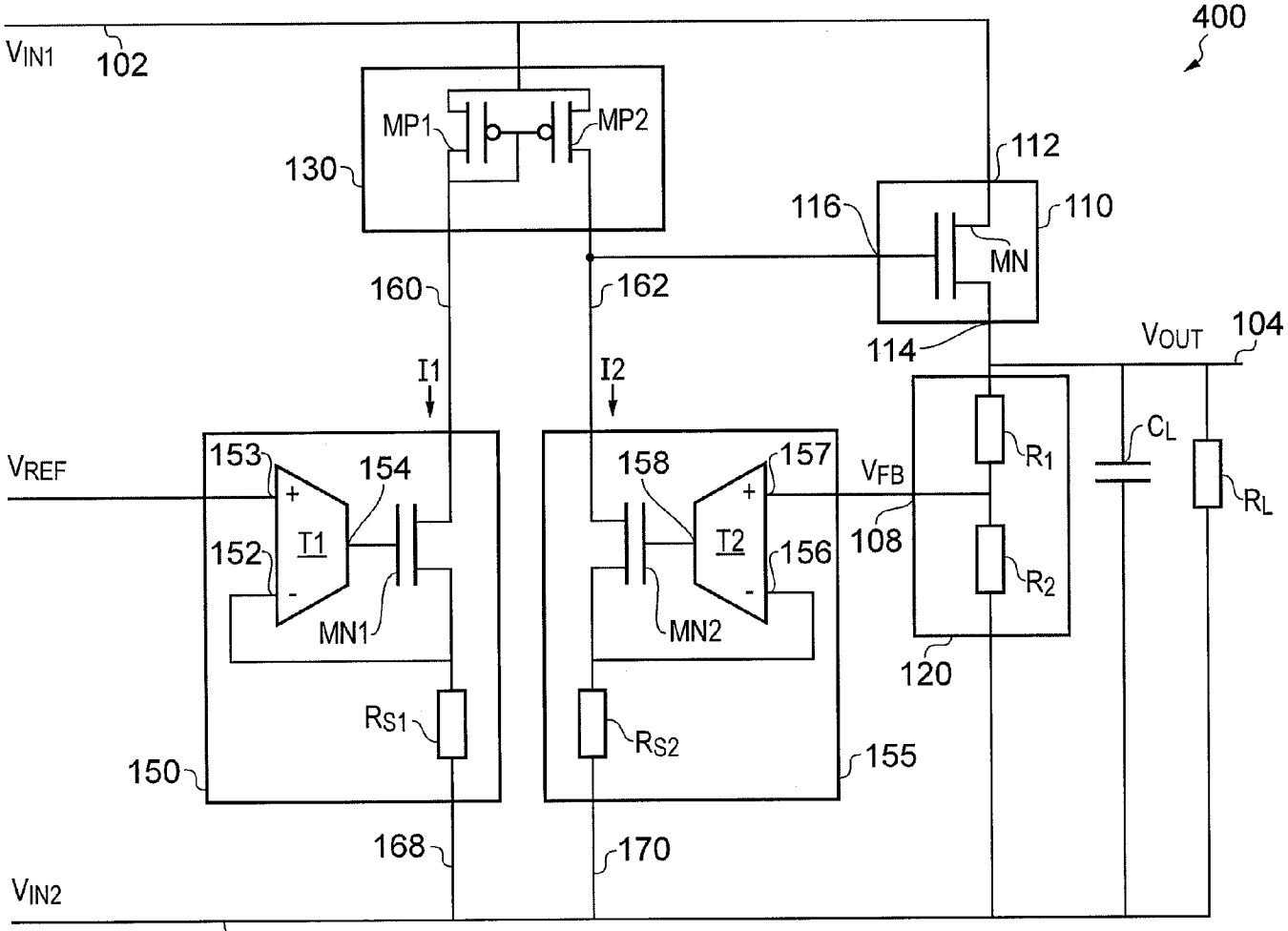
FIG. 9 is a schematic diagram of a voltage regulator for a positive voltage and non-LDO operation.

FIG. 9 illustrates another embodiment of a voltage regulator 400 which is suitable for delivering a positive output voltage $V_{OUT}$, although not suitable for LDO operation. The first input voltage $V_{IN1}$, which is applied at the first input 102, can be positive and the second input voltage $V_{IN2}$, which is applied at the second input 106 can be zero, for example a ground potential. Referring to FIG. 9, the output transistor stage 110 has its first terminal 112 coupled to the first input 102, its second terminal 114 coupled to the output 104, and its control terminal 116 coupled to the second current path 162. The output transistor stage 110 comprises the n-channel output transistor MN in a common drain configuration, having its drain coupled to the first terminal 112, its source coupled to the second terminal 114, and its gate coupled to the control terminal 116. Due to the use of the common drain configuration, the voltage applied at the control terminal 116 must exceed the output voltage $V_{OUT}$ by at least the gate-source threshold voltage of the n-channel output transistor MN, and therefore LDO operation is not provided. The feedback network 120 is coupled between the output 104 and the second input 106. The load resistive element $R_L$ is coupled between the output 104 and the second input 102. The optional load capacitive element $C_L$ is coupled in parallel with the load resistive element $R_L$.

The first transconductance amplifier T1 of the first voltage-to-current converter 150 in the embodiment of FIG. 9 has its first non-inverting input 153 arranged to receive the reference voltage $V_{REF}$, and therefore for convenience is illustrated on the left of FIG. 9. Consequently, in FIG. 9 the first current path 160 is illustrated on the left of the second current path 162. The first inverting input 152 of the first transconductance amplifier T1 is coupled to the second input 106 via the first current sensing resistor $R_{S1}$ and the first connection 168, and its first output 154 is coupled to the first current converter transistor MN1 for controlling the conductivity of the first current converter transistor MN1. The first current converter transistor MN1 is coupled between the first current path 160 and the first current sensing resistor $R_{S1}$. The first current I1 passes through the first current converter transistor MN1, the first current sensing resistor $R_{S1}$ and the first connection 168.

Continuing to refer to FIG. 9, the second transconductance amplifier T2 of the second voltage-to-current converter 155 has its second non-inverting input 157 arranged to receive the feedback voltage $V_{FB}$ from the feedback node 108, its first inverting input 156 is coupled to the second input 106 via the second current sensing resistor $R_{S2}$ and the second connection 170, and its second output 158 is coupled to the second current converter transistor MN2 for controlling the conductivity of the second current converter transistor MN2. The second current converter transistor MN2 is coupled between the second current path 162 and the second current sensing resistor $R_{S2}$. The second current I2 passes through the second current converter transistor MN2, the second current sensing resistor $R_{S2}$ and the second connection 170. The first and second current converter transistors MN1, MN2, are NMOS transistors, as in the embodiment of FIG. 7.

The primary current mirror stage 130 illustrated in FIG. 9 is identical to the primary current mirror stage 130 illustrated in, and described with reference to, FIG. 7, except that the positions of the first and second current mirror transistors MP1, MP2 are swapped to correspond to the positions of the first and second current paths 160, 162. In operation, any deviation of the output voltage $V_{OUT}$ from the target voltage value will result in a change to the feedback voltage $V_{FB}$ and to the second current I2, such that the voltage in the second current path 162 operates to control the output transistor stage 110 to cause the output voltage $V_{OUT}$ to be restored to the target voltage value. In addition, control exerted on the first current I1 by the first voltage-to-current converter 150 in response to the reference voltage $V_{REF}$ is reflected to the second current I2 by the primary current mirror stage 130, and contributes to establishing the target voltage value of the output voltage $V_{OUT}$.

Figure 10:
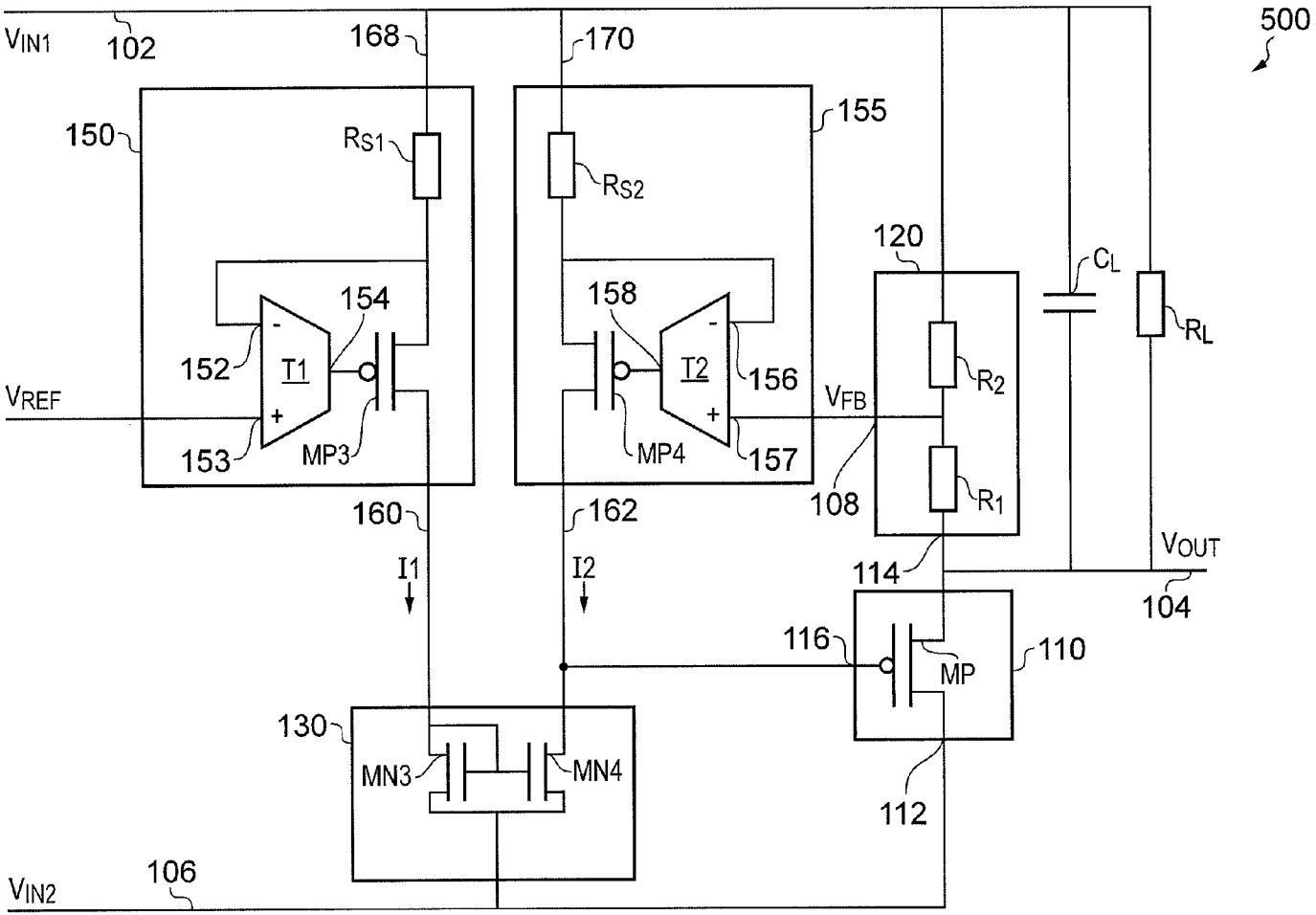
FIG. 10 is a schematic diagram of a voltage regulator for a negative voltage and non-LDO operation.

FIG. 10 illustrates another embodiment of a voltage regulator 500 which is suitable for delivering a negative output voltage $V_{OUT}$, although not suitable for LDO operation. The first input voltage $V_{IN1}$, which is applied at the first input 102, can be zero, for example a ground potential, and the second input voltage $V_{IN2}$, which is applied at the second input 106 can be negative. Referring to FIG. 10, the output transistor stage 110 has its first terminal 112 coupled to the second input 106, its second terminal 114 coupled to the output 104, and its control terminal 116 coupled to the second current path 162. The output transistor stage 110 comprises the p-channel output transistor MP in a common drain configuration, having its drain coupled to the first terminal 112, its source coupled to the second terminal 114, and its gate coupled to the control terminal 116. Due to the use of the common drain configuration, the voltage applied at the control terminal 116 must be less than the output voltage $V_{OUT}$ by at least the gate-source threshold voltage of the output transistor MP, and therefore LDO operation is not provided. The feedback network 120 is coupled between the output 104 and the first input 102. The load resistive element $R_L$ is coupled between the output 104 and the first input 102. The optional load capacitive element $C_L$ is coupled in parallel with the load resistive element $R_L$.

The first transconductance amplifier T1 of the first voltage-to-current converter 150 in the embodiment of FIG. 10 has its first non-inverting input 153 arranged to receive the reference voltage $V_{REF}$, and therefore for convenience is illustrated on the left of FIG. 10. Consequently, in FIG. 10 the first current path 160 is illustrated on the left of the second current path 162. The first inverting input 152 of the first transconductance amplifier T1 is coupled to the first input 102 via the first current sensing resistor $R_{S1}$ and the first connection 168, and its first output 154 is coupled to the third current converter transistor MP3 for controlling the conductivity of the third current converter transistor MP3. The third current converter transistor MP3 is coupled between the first current path 160 and the first current sensing resistor $R_{S1}$. The first current I1 passes through the third current converter transistor MP3, the first current sensing resistor $R_{S1}$ and the first connection 168.

Continuing to refer to FIG. 10, the second transconductance amplifier T2 of the second voltage-to-current converter 155 has its second non-inverting input 157 arranged to receive the feedback voltage $V_{FB}$ its second inverting input 156 coupled to the first input 102 via the second current sensing resistor $R_{S2}$ and the second connection 170, and its second output 158 coupled to the fourth current converter transistor MP4 for controlling the conductivity of the fourth current converter transistor MP4. The fourth current converter transistor MP4 is coupled between the second current path 162 and the second current sensing resistor $R_{S2}$. The second current I2 passes through the fourth current converter transistor MP4, the second current sensing resistor $R_{S2}$ and the second connection 170. The third and fourth current converter transistors MP3, MP4, are PMOS transistors, as in the embodiment of FIG. 8.

The primary current mirror stage 130 illustrated in FIG. 10 is identical to the primary current mirror stage 130 illustrated in, and described with reference to, FIG. 8, except that the positions of the third and fourth current mirror transistors MN3, MN4 are swapped to correspond to the positions of the first and second current paths 160, 162. In operation, any deviation of the output voltage $V_{OUT}$ from the target voltage value will result in a change to the feedback voltage $V_{FB}$ and to the second current I2, such that the voltage in the second current path 162 operates to control the output transistor stage 110 to cause the output voltage $V_{OUT}$ to be restored to the target voltage value. In addition, control exerted on the first current I1 by the first voltage-to-current converter 150 in response to the reference voltage $V_{REF}$ is reflected to the second current I2 by the primary current mirror stage 130, and contributes to establishing the target voltage value of the output voltage $V_{OUT}$.

In order that the voltage regulator 100 has a fast operation, it is desirable for the main feedback loop, formed by the output transistor stage 110, the feedback network 120, the first and second voltage-to-current converters 150, 155, the primary current mirror stage 130 and the second current path 162, to have a high gain. The output impedance of the primary current mirror stage 130 contributes to determining the open loop gain of the main feedback loop. If any errors from the first and second voltage-to-current converters 150, 155 are neglected, then the open loop gain A of the main feedback loop can be approximated at low frequencies by the expression $A=(gm_{MP}\cdot R_L)\cdot(ro_1+ro_2)/(R_{S1}+R_{S2})$ where $gm_{MP}$ is the transconductance of the output transistor stage 110, and in particular of the p-channel output transistor MP or the n-channel output transistor MN, $R_L$ represents the resistance of a load resistive element $R_L$ coupled to the output 104, $ro_1$ is the output resistance of the primary current mirror stage 130 presented to the first current path 160, $ro_2$ is the output resistance of the primary current mirror stage 130 presented to the second current path 162, and $R_{S1}$ and $R_{S2}$ represent the resistance of, respectively, the first and second current sense resistors $R_{S1}$, $R_{S2}$.

The gain and bandwidth of the voltage regulator can be increased by adding a differential amplifier operating in parallel with the main feedback loop to provide an auxiliary feedback loop. Such embodiments are illustrated in FIG. 11 for a voltage regulator 600 which is suitable for delivering a positive output voltage $V_{OUT}$, and in FIG. 12 for a voltage regulator 700 which is suitable for delivering a negative output voltage $V_{OUT}$.

Figure 11:
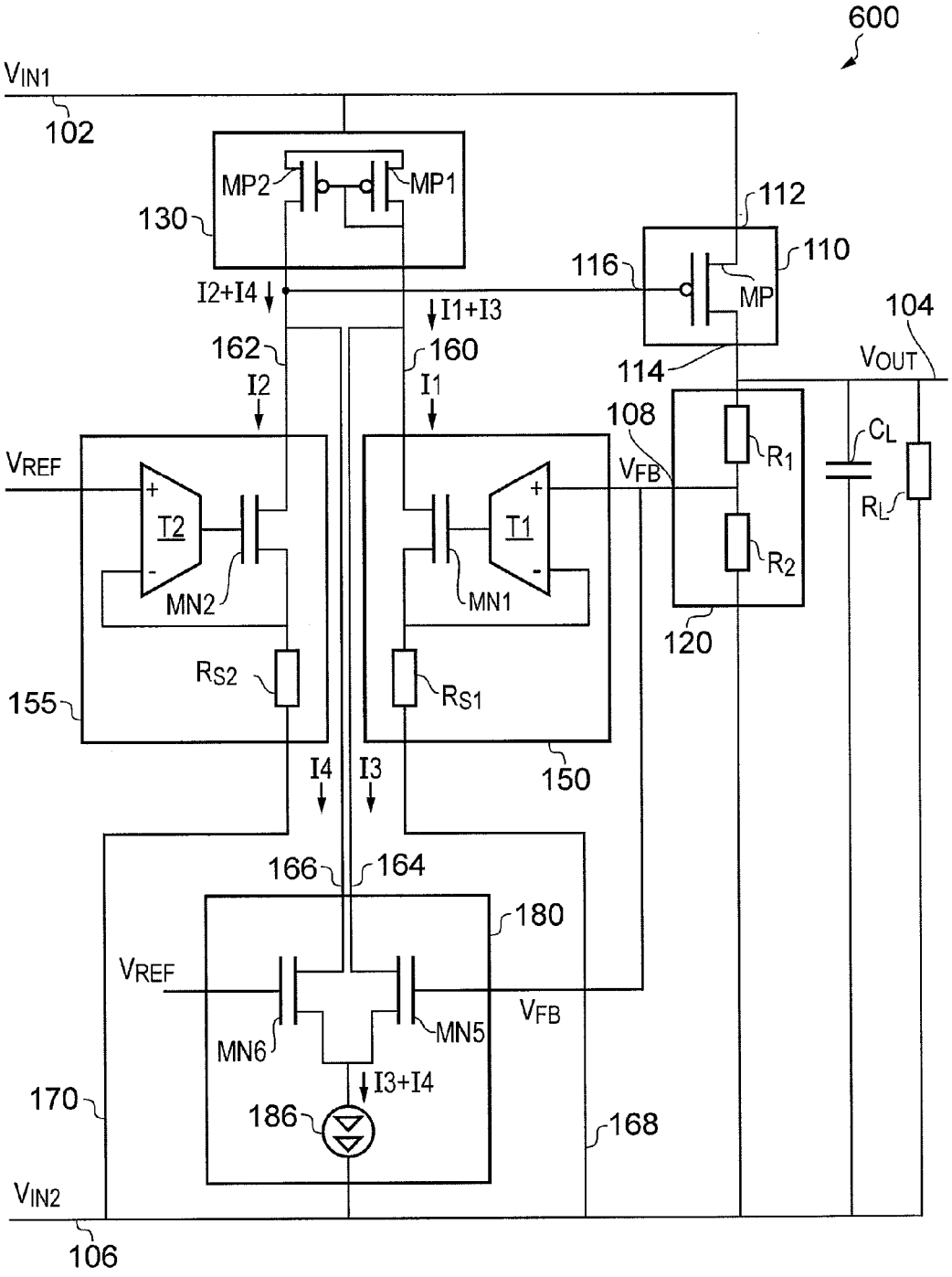
FIG. 11 is a schematic diagram of a voltage regulator for a positive voltage and including a differential amplifier.

Referring to FIG. 11, the voltage regulator 600 comprises the same elements as the voltage regulator 200 of FIG. 7, which therefore are not described again except where additional features are included, and in addition a differential amplifier 180 is coupled to the primary current mirror stage 130 by means of a third current path 164 for conveying a third current I3 and is coupled to the primary current mirror stage 130 by means of a fourth current path 166 for conveying a fourth current I4. In this illustrated arrangement, these couplings are via, respectively, a portion of the first and second current paths 160, 162. Therefore, in this arrangement, a portion of the first current path 160 conveys not only the first current I1 but also the third current I3, and a portion of the second current path 162 conveys not only the second current I2 but also the fourth current I4. The primary current mirror stage 130 delivers the sum of the first and third currents I1+I3 to the first current path 160, and the sum of the second and fourth currents I2+I4 to the second current path 162. The primary current mirror stage 130 controls the sum of the second and fourth currents I2+I4 dependent on the sum of the first and third currents I1+I3 by reflecting the sum of the first and third currents I1+I3 such that the sum of the second and fourth currents I2+I4 is related to the sum of the first and third currents I1+I3 by the current mirror ratio M. The current mirror ratio M may have a value of one, in which case the sum of the first and third currents I1+I3 is equal to the sum of the second and fourth currents I2+I4, or may be greater than one, in which case the sum of the second and fourth currents I2+I4 exceeds the sum of the first and third currents I1+I3. Furthermore, the differential amplifier 180 is coupled to the feedback network 120 and is arranged to control the third current I3 dependent on the feedback voltage $V_{FB}$ and to control the fourth current I4 dependent on the reference voltage $V_{REF}$. In this way, in the embodiment of FIG. 11, the primary current mirror stage 130 controls both the second current I2 and the fourth current I4 dependent on both the first current I1 and the third current I3. In order to increase the stability and phase margin of the voltage regulator 600, it is preferable for the third and fourth currents I3, I4 to be relatively small compared to, respectively, the first and second currents I1, I2, for example by a factor of at least ten.

In FIG. 11, the third current path 164 and the fourth current path 166 are illustrated coupled to, respectively, the first and second current paths 160, 162 externally to the primary current mirror stage 130. However, equivalently, the third current path 164 and the fourth current path 166 can be coupled to, respectively, the first and second current paths 160, 162 internally to the primary current mirror stage 130.

In the embodiment illustrated in FIG. 11, the differential amplifier 180 comprises a first differential amplifier transistor MN5 and a second differential amplifier transistor MN6, these both being NMOS transistors. The first and second differential amplifier transistors MN5, MN6 have their sources coupled to a current source 186 which conveys the sum of the third and fourth currents I3+I4, and their drains coupled to, respectively, the third current path 164 and the fourth current path 166. The first differential amplifier transistor MN5 has its gate coupled to the feedback node 108 for receiving the feedback voltage $V_{FB}$, and the second differential amplifier transistor MN6 has its gate coupled to the reference voltage $V_{REF}$. Other embodiments of the differential amplifier 180 may alternatively be used.

Figure 12:
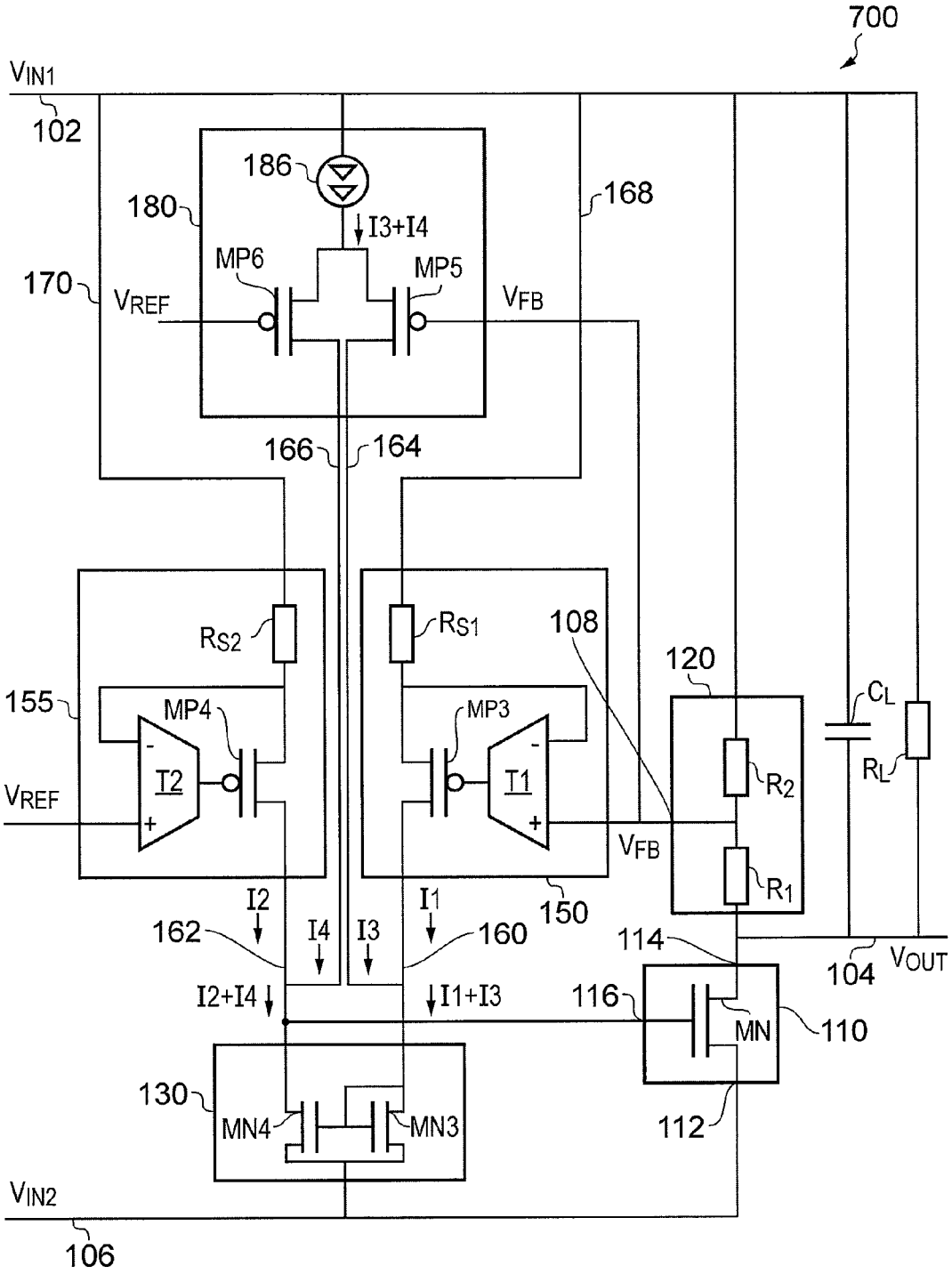
FIG. 12 is a schematic diagram of a voltage regulator for a negative voltage and including a differential amplifier.

Referring to FIG. 12, the voltage regulator 700 comprises the same elements as the voltage regulator 300 of FIG. 8, which therefore are not described again except where additional features are included, and in addition the differential amplifier 180 is coupled to the primary current mirror stage 130 by means of the third current path 164 for conveying the third current I3 and is coupled to the primary current mirror stage 130 by means of the fourth current path 166 for conveying the fourth current I4. As in the embodiment of FIG. 11, a portion of the first current path 160 conveys not only the first current I1 but also the third current I3, and a portion of the second current path 162 conveys not only the second current I2 but also the fourth current I4. The primary current mirror stage 130 receives the sum of the first and third currents I1+I3 via the first current path 160, and the sum of the second and fourth currents I2+I4 via the second current path 162. The primary current mirror stage 130 controls the sum of the second and fourth currents I2+I4 dependent on the sum of the first and third currents I1+I3 by reflecting the sum of the first and third currents I1+I3 such that the sum of the second and fourth currents I2+I4 is related to the sum of the first and third currents I1+I3 by the current mirror ratio M. Again, the current mirror ratio M may have a value of one, or may be greater than one, in the latter case the sum of the second and fourth currents I2+I4 exceeding the sum of the first and third currents I1+I3. Furthermore, the differential amplifier 180 is coupled to the feedback node 108 and is arranged to control the third current I3 dependent on the feedback voltage $V_{FB}$ and to control the fourth current I4 dependent on the reference voltage $V_{REF}$. In this way, in the embodiment of FIG. 12, the primary current mirror stage 130 controls both the second current I2 and the fourth current I4 dependent on both the first current I1 and the third current I3. Again, in order to increase the stability and phase margin of the voltage regulator 700, it is preferable for the third and fourth currents I3, I4 to be relatively small compared to, respectively, the first and second currents I1, I2, for example by a factor of at least ten.

In FIG. 12, the third current path 164 and the fourth current path 166 are illustrated coupled to, respectively, the first and second current paths 160, 162 externally to the primary current mirror stage 130. However, equivalently, the third current path 164 and the fourth current path 166 can be coupled to, respectively, the first and second current paths 160, 162 internally to the primary current mirror stage 130.

In the embodiment illustrated in FIG. 12, the differential amplifier 180 comprises a third differential amplifier transistor MP5 and a fourth differential amplifier transistor MP6, these both being PMOS transistors. The third and fourth differential amplifier transistors MP5, MP6 have their sources coupled to the current source 186 which delivers the sum of the third and fourth currents I3+I4, and their drains coupled to, respectively, the third current path 164 and the fourth current path 166. The third differential amplifier transistor MP5 has its gate coupled to the feedback node 108 for receiving the feedback voltage $V_{FB}$, and the second differential amplifier transistor MN6 has its gate coupled to the reference voltage $V_{REF}$. Other embodiments of the differential amplifier 180 may alternatively be used.

The gain and bandwidth of the voltage regulators 600, 700 of FIGS. 11 and 12 can be increased by employing cascoded or wide-swing current mirror circuitry in the primary current mirror stage 130 and coupling the differential amplifier 180 to high impedance points of such current mirror circuitry via the third and fourth current paths I3, I4. An embodiment of the primary current mirror stage 130 employing such wide-swing current mirror circuitry is illustrated in FIG. 13.

Figure 13:
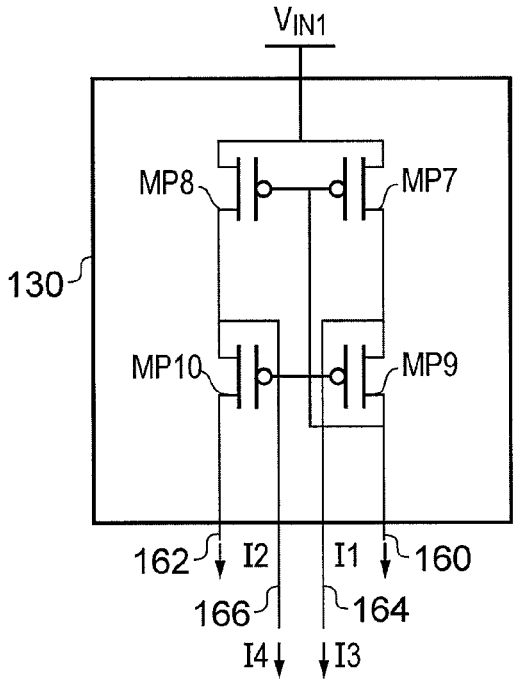
FIG. 13 is a schematic diagram of a primary current mirror stage.

Referring to FIG. 13, the primary current mirror stage 130 comprises a fifth current mirror transistor MP7 and a sixth current mirror transistor MP8, these both being PMOS transistors. The fifth and sixth current mirror transistors MP7, MP8 have their sources coupled to the first input voltage $V_{IN1}$ and their gates coupled together, thereby establishing common operating conditions for the fifth and sixth current mirror transistors MP7, MP8. In addition, there is a seventh current mirror transistor MP9 and an eighth current mirror transistor MP10, these also both being PMOS transistors. The seventh and eighth current mirror transistors MP9, MP10 have their gates coupled together and to a non-illustrated bias voltage, their sources coupled to respective drains of the fifth and sixth current mirror transistors MP7, MP8 and to the third and fourth current paths 164, 166 respectively, and their drains are coupled to the first and second current paths 160, 162 respectively. Therefore, the seventh and eighth current mirror transistors MP9, MP10 conduct, respectively, the first and second current I1, I2, the fifth current mirror transistor MP7 conducts the first and third currents I1, I3 in combination, and the sixth current mirror transistor MP8 conducts the second and fourth currents I2, I4 in combination. If the differential amplifier 180 is balanced, then the third and fourth currents I3 and I4 are related by the current mirror ratio M and the balance established in the bridge formed by the primary current mirror stage 130, the first and second voltage-to-current converters 150, 155 and the first and second current paths 160, 162 is maintained.

In a further embodiment, additional mirroring of currents may be employed. Such an architecture enables a sliced based, that is, modular, approach to constructing a voltage regulator using a plurality of cells of the same type. A single cell can be designed, and then repeated many times, according to the desired size of current to be delivered by the voltage regulator.

Figure 14:
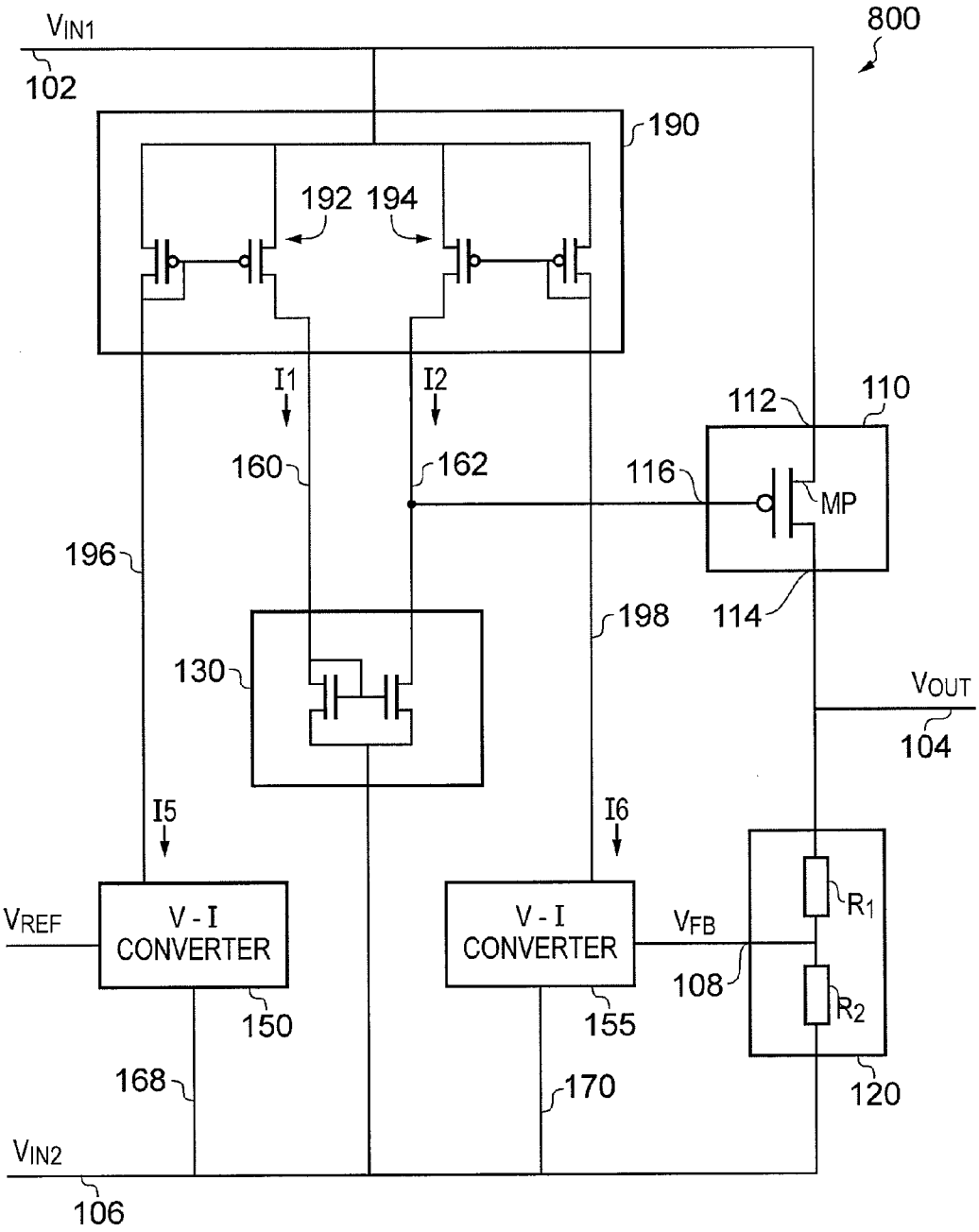
FIG. 14 is a schematic diagram of a voltage regulator with additional current mirroring.

FIG. 14 illustrates a voltage regulator 800 employing a single cell architecture. Referring to FIG. 14, the output transistor stage 110, which comprises the p-channel output transistor MP, has its first terminal 112 coupled to the first input 102, its second terminal 114 coupled to the output 104 and its control terminal 116 coupled to the second current path 162. The feedback network 120 is coupled between the output 104 and the second input 106. There is a secondary current mirror stage 190 coupled to the first input 102 for receiving the first input voltage $V_{IN1}$ and comprising a first secondary current mirror device 192 and a second secondary current mirror device 194. The first secondary current mirror device 192 is coupled to the primary current mirror stage 130 via the first current path 160 for conveying the first current I1, and is coupled to the first voltage-to-current converter 150 via a third current path 196 for conveying a fifth current I5. The second secondary current mirror device 194 is coupled to the primary current mirror stage 130 via the second current path 162 for conveying the second current I2, and is coupled to the second voltage-to-current converter 155 via a fourth current path 198 for conveying a sixth current I6. The first voltage-to-current converter 150 is coupled to the second input 106 via the first connection 168 for receiving the second input voltage $V_{IN2}$ and for conveying the fifth current I5, and controls the fifth current I5 dependent on the reference voltage $V_{REF}$. The second voltage-to-current converter 155 is coupled to the second input 106 via the second connection 170 for receiving the second input voltage $V_{IN2}$ and for conveying the sixth current I6, and to the feedback node 108 for receiving the feedback voltage $V_{FB}$, and controls the sixth current I6 dependent on the feedback voltage $V_{FB}$. As in all embodiments, the first and second connections 168, 170 are separate, that is they provide independent current paths, enabling the voltage-to-current conversion performed by the second voltage-to-current converter 155 to be independent of the voltage-to-current conversion performed by the first voltage-to-current converter 150, but enabling linear superposition in the second current I2 of the effects of the voltage-to-current conversion performed by the first and second voltage-to-current converters 150, 155. The first voltage-to-current converter 150 and the second voltage-to-current converter 155 can have, for example, the internal architecture illustrated in FIG. 5.

Figure 15:
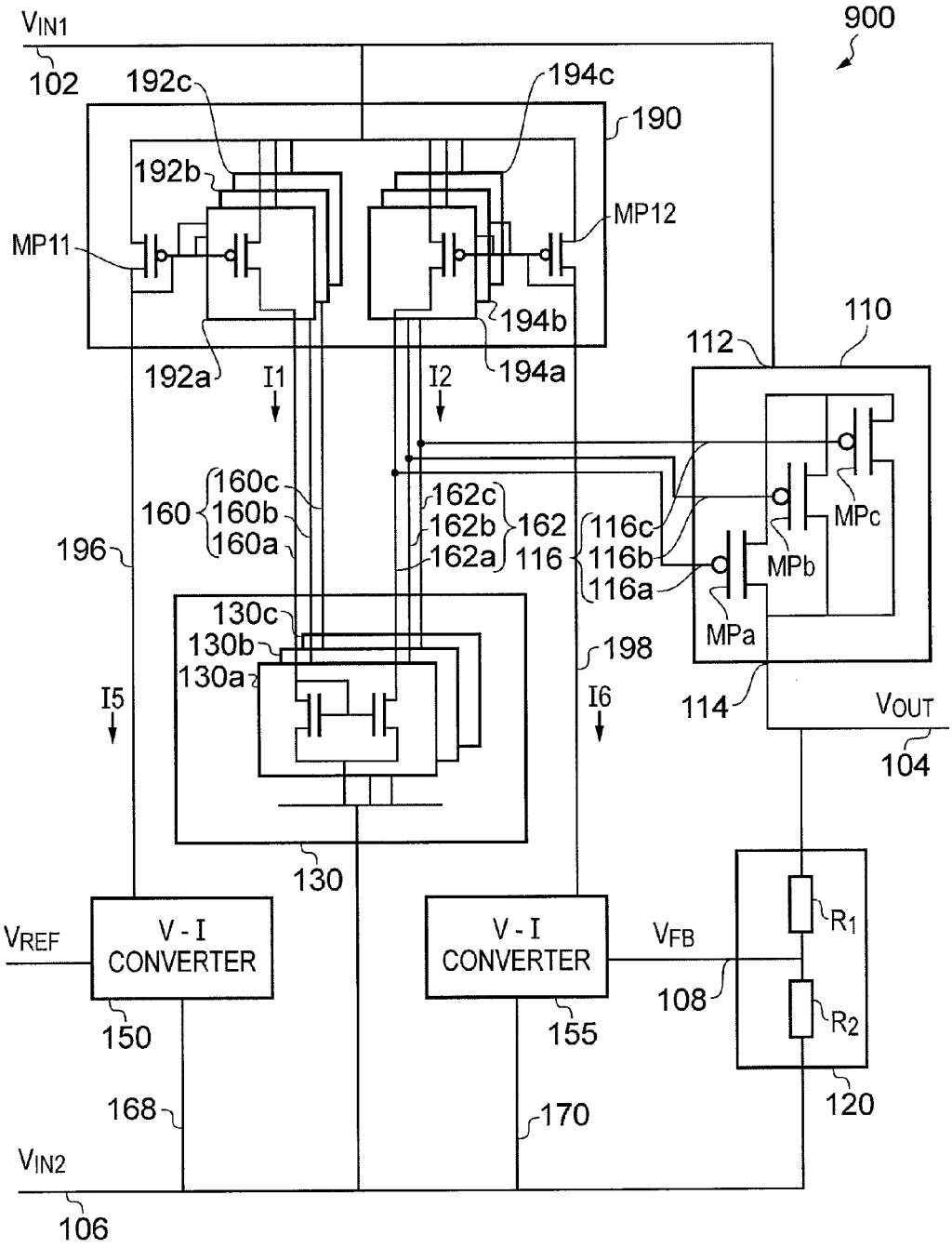
FIG. 15 is a schematic diagram of a voltage regulator with a modular structure.

In operation, the first secondary current mirror device 192 controls the first current I1 to be a reflection of the fifth current I5, the primary current mirror stage 130 controls the second current to be a reflection of the first current I1, and the second secondary current mirror device 194 controls the second current I2 to be a reflection of the sixth current I6. Therefore, changes in the sixth current I6 introduced by the second voltage-to-current converter 155 in response to changes in the feedback voltage $V_{FB}$ are reflected in the second current I2 by the seconds secondary current mirror device 194. Similarly, control of the fifth current I5 by the first voltage-to-current converter 150 in response to the reference voltage $V_{REF}$ is reflected in the first current I1 by the first secondary current mirror device 192, and consequently reflected in the second current I2 by the primary current mirror stage 130 where they can be linearly superimposed on the changes in second current I2 due to the changes in the feedback voltage $V_{FB}$. The first secondary current mirror device 192 and the second secondary current mirror device 194 may operate with the same or different current mirror ratios, which may be the same as, or different from, the current mirror ratio M of the primary current mirror stage 130. Under quiescent conditions when the output voltage $V_{OUT}$ is at the target voltage value, the current bridge formed by the primary current mirror stage 130, the first and second current paths 160, 162 and the first and second voltage-to-current converters 150, 155 via the intermediary of the secondary current mirror stage 190, is in balance. As in the case of the other embodiments described, any deviation of the output voltage $V_{OUT}$ from the target voltage value will result in a change to the feedback voltage $V_{FB}$ and to the first and second currents I1, I2, such that the voltage in the second current path 162 operates to control the output transistor stage 110 to cause the output voltage $V_{OUT}$ to be restored to the target voltage value. In FIG. 15, the embodiment of FIG. 14 is extended to a voltage regulator 900 employing a three cell architecture, although other numbers of cells may be used. Referring to FIG. 15, the output transistor stage 110 comprises three sub-output transistors MPa, MPb, MPc each having a source coupled to the first input 102 via the first terminal 112 and each having a drain coupled to the output 104 via the second terminal 114. A gate of each of the three sub-output transistors MPa, MPb, MPc is coupled to respective ones of three control sub-terminals 116*a*, 116*b*, 116*c* which together form the control terminal 116. In this way, the current delivered at the second terminal 114 is sum of the three currents delivered to the second terminal 114 by the three sub-output transistors MPa, MPb, MPc.

The first current path 160 comprises three first current sub-paths 160*a*, 160*b*, 160*c* for each conveying a proportion of the first current I1, and the second current path 162 comprises three second current sub-paths 162*a*, 162*b*, 162*c* for each conveying a proportion of the second current I2. Each of the three control sub-terminals 116*a*, 116*b*, 116*c* is coupled to a different one of the three second current sub-paths 162*a*, 162*b*, 162*c* such that the conductivity of the respective sub-output transistors MPa, MPb, MPc between the first input 102 and the output 104 is dependent on a voltage in the respective first current sub-paths 160*a*, 160*b*, 160*c*.

The primary current mirror stage 130 in the embodiment of FIG. 15. comprises three identical primary current mirror devices 130*a*, 130*b*, 130*c* each coupled to a respective one of the first current sub-paths 160*a*, 160*b*, 160*c* and a respective one of the second current sub-paths 162*a*, 162*b*, 162*c*, and each arranged to reflect the current in the respective one of the first current sub-paths 160*a*, 160*b*, 160*c* in the respective one of the second current sub-paths 162*a*, 162*b*, 162*c* according to the current mirror ratio M.

The secondary current mirror stage 190 comprises three secondary current mirror devices 192*a*, 192*b*, 192*c* coupled to respective ones of the first current sub-paths 160*a*, 160*b*, 160*c*. Three current mirrors are formed by each of the three secondary current mirror devices 192*a*, 192*b*, 192*c* being coupled to a common ninth current mirror transistor MP11 which conducts the fifth current I5 current of the first voltage-to-current converter 150 and reflects that current to each of the first current sub-paths 160*a*, 160*b*, 160*c*. Furthermore, the secondary current mirror stage 190 comprises three further secondary current mirror devices 194*a*, 194*b*, 194*c* coupled to respective ones of the second current sub-paths 162*a*, 162*b*, 162*c*. Three further current mirrors are formed by each of the three further secondary current mirror devices 194*a*, 194*b*, 194*c* being coupled to a common tenth current mirror transistor MP12 which conducts the sixth current I6 of the second voltage-to-current converter 155 and reflects that current to each of the second current sub-paths 162*a*, 162*b*, 162*c*.

Each of the three cells may be constructed comprising one each of the sub-output transistors MPa, MPb, MPc, the primary current mirror devices 130*a*, 130*b*, 130*c*, the secondary current mirror devices 192*a*, 192*b*, 192*c*, the further secondary current mirror devices 194*a*, 194*b*, 194*c*, the first current sub-paths 160*a*, 160*b*, 160*c* and the second current sub-paths 162*a*, 162*b*, 162*c*. By employing identical cells and operating conditions, the current in each cell is the same, and an arbitrary current can be delivered at the output 104 by employing an arbitrary number of the cells.

In the embodiment of FIG. 15, the feedback stage 120, the first and second voltage-to-current converters 150, 155 and the first and second connections 168, 170 are identical to the feedback stage 120, the first and second voltage-to-current converters 150, 155 and the first and second connections 168, 170 in the embodiment of FIG. 14.

The voltage regulator 800 illustrated in FIG. 14 and the voltage regulator 900 illustrated in FIG. 15 are suitable for providing a positive output voltage $V_{ouT}$. The secondary current mirror stage 190 can also be employed in conjunction with voltage regulators for providing a negative output voltage $V_{OUT}$.

Figure 16:
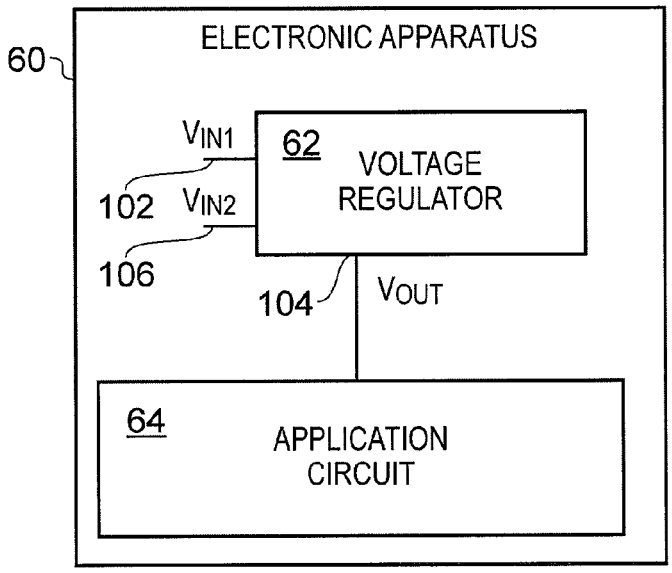
FIG. 16 is a schematic diagram of an electronic apparatus comprising a voltage regulator.

Referring to FIG. 16, an electronic apparatus 60 comprises a voltage regulator 62 in accordance with the invention and having the first input 102 for the first input voltage $V_{IN1}$ and the second input 106 for the second input voltage $V_{IN2}$, which may be provided by, for example, a battery internal or external to the electronic device 60, and the output 104 coupled to an application circuit 64 for delivering the output voltage $V_{OUT}$ to the application circuit 64. The application circuit 64 provides a load for the voltage regulator 62. The electronic device 60 may be, for example, a mobile phone or a portable computer, or an integrated circuit for use in such apparatus.

Additional embodiments of voltage regulators are described below which illustrate other variations that fall within the scope of the invention, including the provision of plural independent output voltages from different source voltages and grounds. These additional embodiments will be recognized as variations of the regulators 400, 500, 800, and 900 described above in connection with FIGS. 9, 10, 14, and 15. Despite the variations employed in each of the embodiments of the voltage regulator, according to the terminology used throughout this description and the accompanying claims, for each additional embodiment, a primary current mirror stage controls a plurality of second currents in a respective plurality of second current paths to be a reflection of a first current I1 in a first current path 160. A plurality of control terminals of respective ones of a plurality of output transistor stages in each additional embodiment are coupled to respective ones of the second current paths conveying the plurality of second currents, and each additional embodiment includes a plurality of second V-I converters and a respective plurality of feedback networks.

In this way, several regulators on an integrated circuit chip can use the same reference current source, which may be advantageously placed near the bandgap reference. An extra transistor in the primary current mirror 130 shown in FIG. 9 provides a reference current for a respective secondary regulator, which is substantially just a copy of part of the single regulator. The modified primary current mirror with all extra currents must be a central block, but the secondary regulator(s) can be anywhere on the chip and need only one respective conductor for the reference current from the modified primary current mirror. The secondary regulator(s) can have different (local) grounds and different (local) supply voltages, and the resistances in their respective feedback networks can be chosen to generate respective, different regulated voltage(s).

Figure 17:
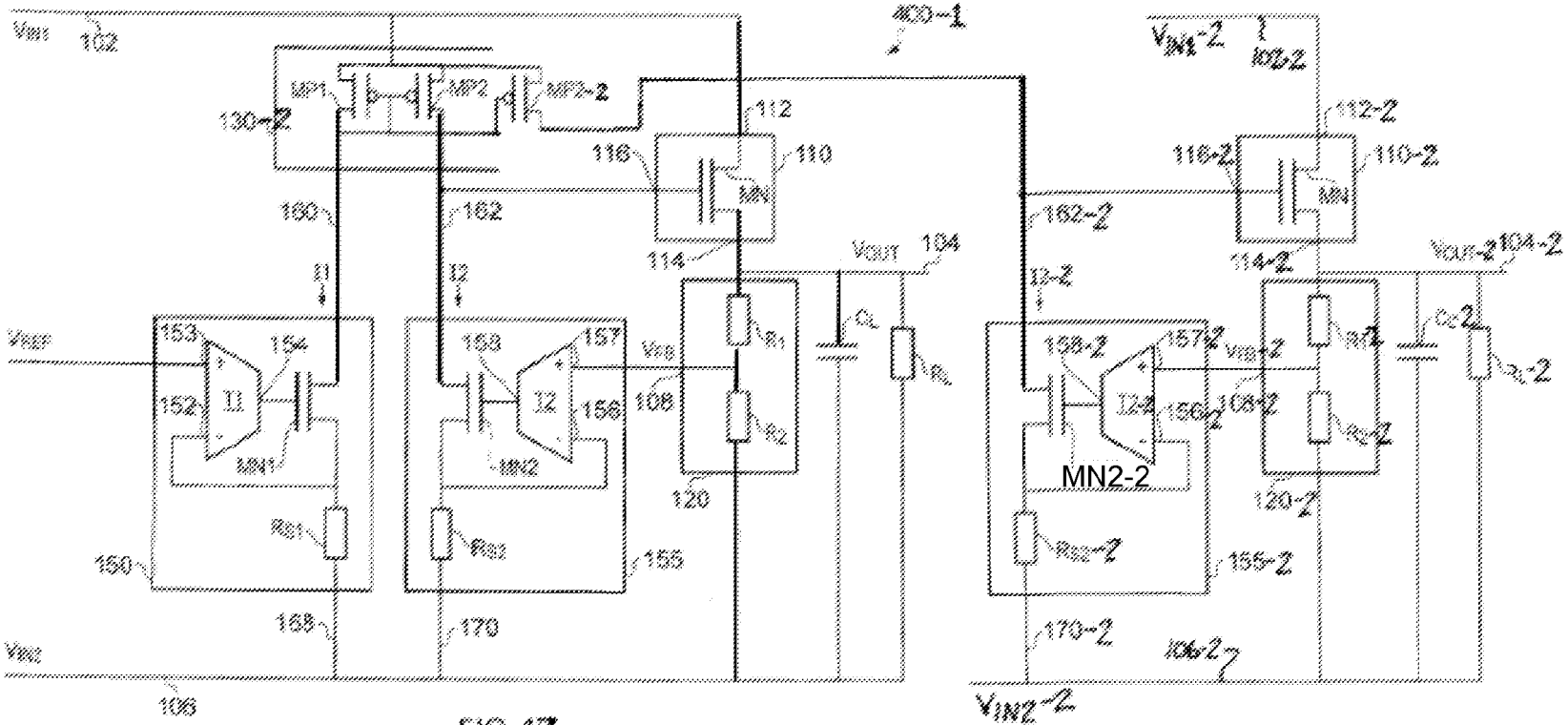
FIG. 17 is a schematic diagram of a voltage regulator for a plurality of positive output voltages.

FIG. 17 illustrates a voltage regulator 400-1 having the same general architecture as the voltage regulator 400 illustrated in FIG. 9 but including a secondary regulator stage. Components in FIG. 17 that are the same as components in FIG. 9 have the same reference numerals. The secondary regulator stage includes a secondary output stage 110-2, a secondary feedback network 120-2, and a secondary second voltage-to-current converter 155-2. It should be understood that FIG. 17 depicts an arrangement having one secondary regulator stage configured for two regulated output voltages $V_{OUT}$, $V_{OUT}$-2, but more than two output voltages can be provided by including additional secondary regulator stages and additional transistors in the primary current mirror 130.

In FIG. 17, a secondary first input voltage $V_{IN1}$-2 is applied at a secondary first input 102-2 and can be positive, and a secondary second input voltage $V_{IN2}$-2 is applied at a secondary second input 106-2 and can be zero, for example a ground potential. The voltages $V_{IN1}$, $V_{IN1}$-2 need not be the same, although those voltages need to be such that the working conditions of the transistors 110, 110-2 are correct to provide the regulated voltages $V_{OUT}$, $V_{OUT}$-2. This can be an advantage if the secondary output stage 110-2 is supplied by a separate DC-DC converter or other source that has some tolerance against the supply of the output stage 110. In addition, the "grounds" $V_{IN2}$, $V_{IN2}$-2 can also be slightly different, e.g., 100 mV, which can help to refer the secondary regulated voltage $V_{OUT}$-2 to the local ground value that can differ from the ground voltage on other points of a chip due to currents or different ground domains, such as different pads to a common external ground plane.

Because these are current mirrors, if the voltage at the sources of both mirror transistors changes, the output current is still the same (or at least nearly the same). It will be noted that the two transistors of one current mirror (the ones with connected gates) must have the same source voltage (i.e., the same supply or ground). In the voltage regulator 400-1 depicted in FIG. 17, since $V_{IN1}$-2 is used only for transistor 110-2, not much difference between $V_{IN1}$ and $V_{IN1}$-2 can be tolerated because it changes the voltage at secondary second current path 162-2 as well.

It is also believed to be important for the "ground" voltage of a V-I converter and its respective feedback network to be the same. Thus, $V_{IN2}$ should be the same for converter 155 and network 120, and in FIG. 17, $V_{IN2}$-2 should be the same for the converters 155-2 and network 120-2. Furthermore, resistors used in the second V-I converters 155, 155-2 should have the substantially the same values, sizes, orientations, and surroundings because otherwise, the matching with the first V-I converter 150 can be bad and the regulator(s) output(s) can have a tolerance against $V_{REF}$.

As in FIG. 9, the secondary output transistor stage 110-2 has its first terminal 112-2 coupled to the first input 102-2, its second terminal 114-2 coupled to the output 104-2, and its control terminal 116-2 coupled to the secondary second current path 162-2. The secondary output transistor stage 110-2 also comprises an n-channel output transistor MN-2 in a common drain configuration, having its drain coupled to the first terminal 112-2, its source coupled to the second terminal 114-2, and its gate coupled to the control terminal 116-2. Due to the use of the common drain configuration, the voltage applied at the control terminal 116-2 must exceed the output voltage $V_{OUT}$-2 by at least the gate-source threshold voltage of the n-channel output transistor MN-2, else LDO operation is not provided. The secondary feedback network 120-2 is coupled between the output 104-2 and the second input 106-2. A secondary load resistive element $R_L$-2 is coupled between the secondary output 104-2 and the secondary second input 106-2. An optional secondary load capacitive element $C_L$-2 is coupled in parallel with the load resistive element $R_L$-2.

The secondary regulator includes a secondary second transconductance amplifier T2-2 of a secondary second voltage-to-current converter 155-2, which has its second non-inverting input 157-2 arranged to receive a secondary feedback voltage $V_{FB}$-2 from a secondary feedback node 108-2 of the secondary feedback network 120-2, its first inverting input 156-2 coupled to the second input 106-2 via a second current sensing resistor $R_{S2}$-2 and a second connection 170-2, and its second output 158-2 coupled to a secondary second current converter transistor MN2-2 for controlling the conductivity of the transistor MN2-2. The secondary second current converter transistor MN2-2 is coupled between the secondary second current path 162-2 and the secondary second current sensing resistor $R_{S2}$-2. The secondary second current I2-2 passes through the secondary second current converter transistor MN2-2, the secondary second current sensing resistor $R_{S2}$-2 and the secondary second connection 170-2. The secondary second current converter transistor MN2-2 is an NMOS transistor.

The primary current mirror stage 130-2 illustrated in FIG. 17 is a modification of the primary current mirror stage shown in FIG. 9. As shown in FIG. 17, the primary current mirror stage 130-2 includes another second current mirror transistor MP2-2 that is a PMOS transistor, and the transistor MP2-2 has its source coupled to the first input 102 for receiving the first input voltage $V_{IN1}$ and its gate coupled to the gate of the other second current mirror transistor MP2, thereby establishing a common operating condition. The secondary second current mirror transistor MP2-2 has its drain coupled to the secondary second current path 162-2 for delivering the secondary second current I2-2 reflected from the first current I1. Other embodiments of the primary current mirror stage 130-2 may alternatively be used.

In operation, any deviation of the secondary output voltage $V_{OUT}$-2 from a target voltage value will result in a change to the secondary feedback voltage $V_{FB}$-2 and to the secondary second current I2-2, such that the voltage in the secondary second current path 162-2 operates to control the secondary output transistor stage 110-2 to cause the secondary output voltage $V_{OUT}$-2 to be restored to the target voltage value. In addition, control exerted on the first current I1 by the first voltage-to-current converter 150 in response to the reference voltage $V_{REF}$ is reflected to the secondary second current I2-2 by the primary current mirror stage 130-2, and contributes to establishing the target voltage value of the secondary output voltage $V_{OUT}$-2.

Figure 18:
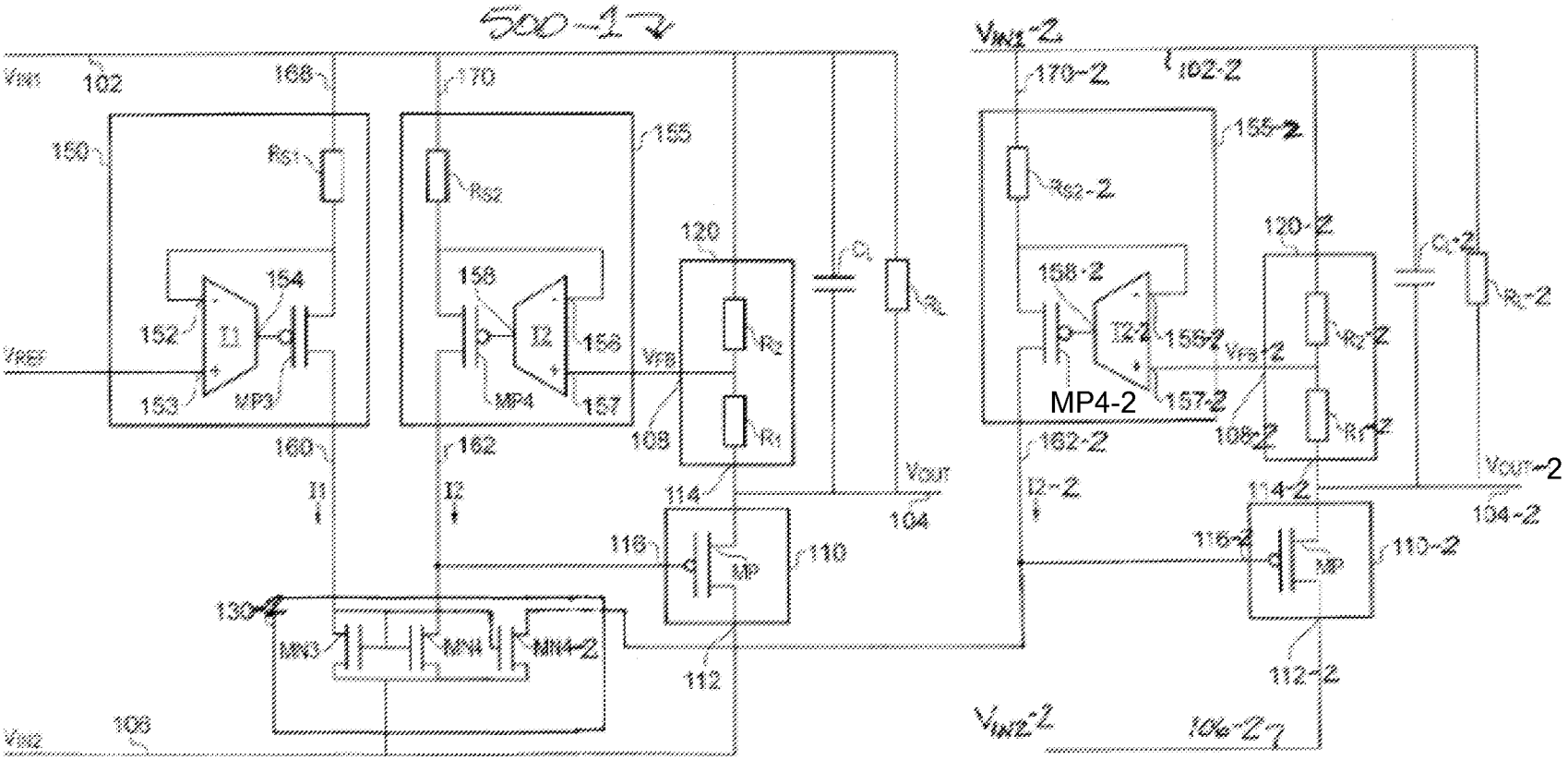
FIG. 18 is a schematic diagram of a voltage regulator for a plurality of negative output voltages.

FIG. 18 illustrates a voltage regulator 500-1 having the same general architecture as the voltage regulator 500 illustrated in FIG. 10 but including a secondary regulator stage. Components in FIG. 18 that are the same as components in FIG. 10 have the same reference numerals. The secondary regulator stage includes a secondary output stage 110-2, a secondary feedback network 120-2, and a secondary second voltage-to-current converter 155-2. It should be understood that FIG. 18 depicts an arrangement having one secondary regulator stage configured for two regulated output voltages $V_{OUT}$, $V_{OUT}$-2, but more than two output voltages can be provided by including additional secondary regulator stages and additional transistors in the primary current mirror 130-2.

The secondary first input voltage $V_{IN1}$-2, which is applied at a secondary first input 102-2, can be zero, for example a ground potential, and the secondary second input voltage $V_{IN2}$-2, which is applied at a secondary second input 106-2 can be negative. Referring to FIG. 18, a secondary output transistor stage 110-2 has its first terminal 112-2 coupled to the second input 106-2, its second terminal 114-2 coupled to the output 104-2, and its control terminal 116-2 coupled to a secondary second current path 162-2. The output transistor stage 110-2 comprises a p-channel output transistor MP in a common drain configuration, having its drain coupled to the first terminal 112-2, its source coupled to the second terminal 114-2, and its gate coupled to the control terminal 116-2. Due to the common drain configuration, the voltage applied at the control terminal 116-2 must be less than the secondary output voltage $V_{OUT}$-2 by at least the gate-source threshold voltage of the output transistor MP, and therefore LDO operation is not provided.

The secondary feedback network 120-2 is coupled between the secondary output 104-2 and the secondary first input 102-2. A secondary load resistive element $R_L$-2 is coupled between the secondary output 104-2 and the secondary first input 102-2. An optional secondary load capacitive element $C_L$-2 is coupled in parallel with the secondary load resistive element.

A secondary second transconductance amplifier T2-2 of the secondary second voltage-to-current converter 155-2 has its second non-inverting input 157-2 arranged to receive a secondary feedback voltage $V_{FB}$-2, its second inverting input 156-2 coupled to the secondary first input 102-2 via a secondary second current sensing resistor $R_{S2}$-2 and a secondary second connection 170-2, and its second output 158-2 coupled to a secondary fourth current converter transistor MP4-2 for controlling the conductivity of the secondary fourth current converter transistor MP4. The secondary fourth current converter transistor MP4 is coupled between a secondary second current path 162-2 and the secondary second current sensing resistor $R_{S2}$-2. A secondary second current I2-2 passes through the secondary fourth current converter transistor MP4, second current sensing resistor $R_{S2}$-2, and secondary second connection 170-2. The third, fourth and secondary fourth current converter transistors MP3, MP4 and MP4-2 are PMOS transistors, as in the embodiment of FIG. 8.

The primary current mirror stage 130-2 illustrated in FIG. 18 is a modification of the primary current mirror stage 130 illustrated in, and described with reference to, FIGS. 8 and 10. As in FIG. 10, the positions of third and fourth current mirror transistors MN3, MN4 are swapped to correspond to the positions of first and second current paths 160, 162. In addition as shown in FIG. 18, the primary current mirror stage 130-2 includes a secondary fourth current mirror transistor MN4-2 that has its source coupled to the second input 106 for receiving the second input voltage $V_{IN2}$ and its gate coupled to the gate of the fourth current mirror transistor MN4, thereby establishing a common operating condition. The secondary fourth current mirror transistor MN4-2 has its drain coupled to the secondary second current path 162-2 for delivering the secondary second current I2-2 reflected from the first current I1. Other embodiments of the primary current mirror stage 130-2 may alternatively be used.

In operation, any deviation of the secondary output voltage $V_{outT}$-2 from a target voltage value will result in a change to the secondary feedback voltage $V_{FB}$-2 and to the secondary second current I2-2, such that the voltage in the secondary second current path 162-2 operates to control the secondary output transistor stage 110-2 to cause the secondary output voltage $V_{OUT}$-2 to be restored to the target voltage value. In addition, control exerted on the first current I1 by the first voltage-to-current converter 150 in response to the reference voltage $V_{REF}$ is reflected to the secondary second current I2-2 by the primary current mirror stage 130-2, and contributes to establishing the target voltage value of the secondary output voltage $V_{OUT}$-2.

Figure 19:
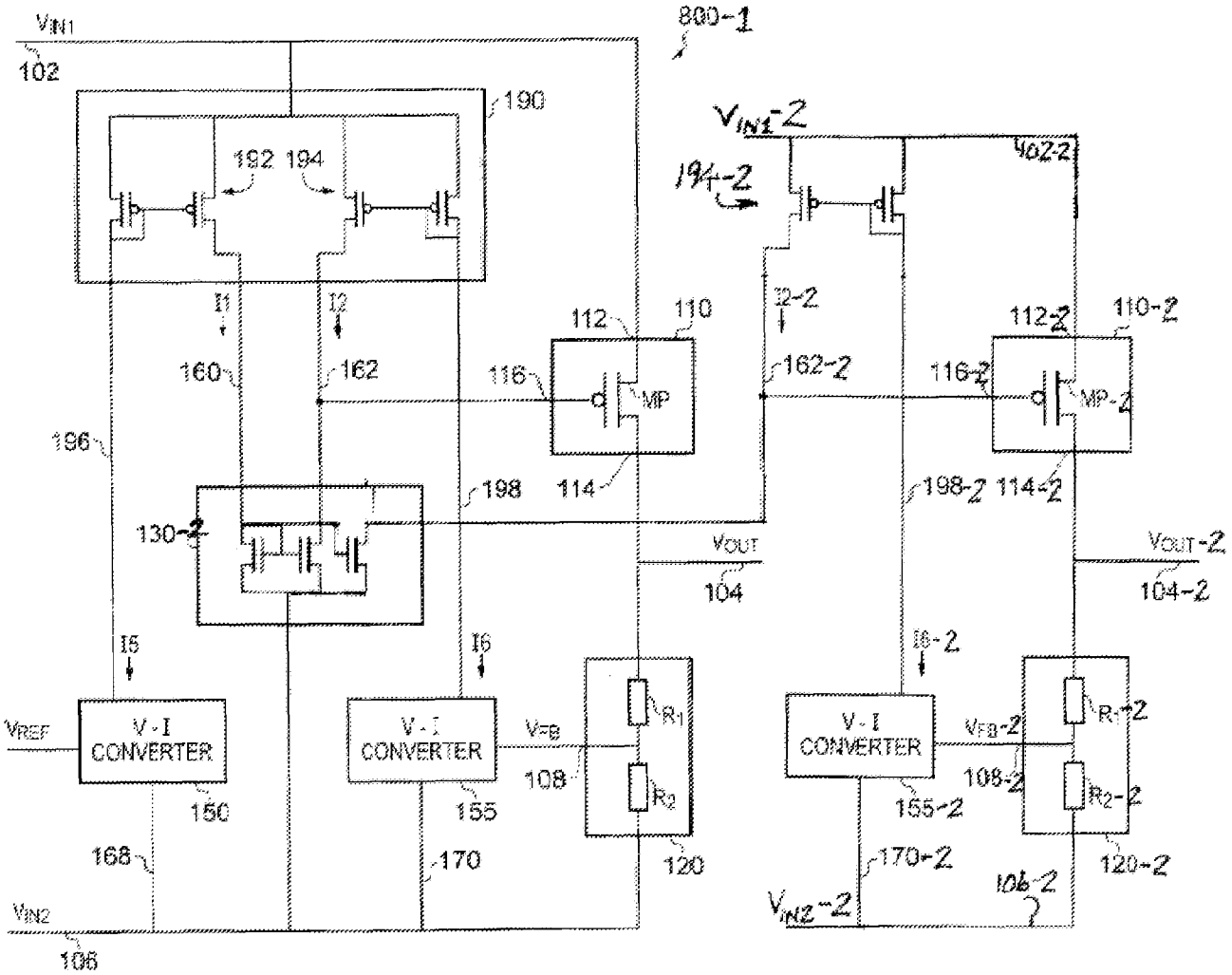
FIG. 19 is a schematic diagram of a voltage regulator with additional current mirroring and a plurality of output voltages.

FIG. 19 illustrates a voltage regulator 800-1 having the same general single-cell architecture as the voltage regulator 800 illustrated in FIG. 14 but including a secondary regulator stage. Components in FIG. 19 that are the same as components in FIG. 14 have the same reference numerals. The secondary regulator stage includes a secondary output stage 110-2, a secondary feedback network 120-2, and a secondary second voltage-to-current converter 155-2. It should be understood that FIG. 19 depicts an arrangement having one secondary regulator stage configured for two regulated output voltages $V_{OUT}$, $V_{OUT}$-2, but more than two output voltages can be provided by including additional secondary regulator stages and additional transistors in the primary current mirror 130-2. It should also be understood that one or more secondary regulator stages can be added in a straightforward way based on FIG. 19 to the voltage regulator 900 depicted in FIG. 15 because, as explained above, the three-cell architecture of FIG. 15 is an extension of the single-cell architecture of FIG. 14.

In FIG. 19, the secondary output transistor stage 110-2 comprises a p-channel output transistor MP having its first terminal 112-2 coupled to a secondary first input 102-2, its second terminal 114-2 coupled to a secondary output 104-2, and its control terminal 116-2 coupled to a secondary second current path 162-2. The secondary feedback network 120-2 is coupled between the secondary output 104-2 and a secondary second input 106-2.

There is a secondary second current mirror stage coupled to the secondary first input 102-2 for receiving a secondary first input voltage $V_{IN1}$-2 and comprising a secondary second current mirror device 194-2 that is coupled to the primary current mirror stage 130-2 via the secondary second current path 162-2 for conveying a secondary second current I2-2, and is coupled to the secondary second voltage-to-current converter 155-2 via a secondary fourth current path 198-2 for conveying a secondary sixth current I6-2. The secondary second voltage-to-current converter 155-2 is coupled to the secondary second input 106-2 via a secondary second connection 170-2 for receiving a secondary second input voltage $V_{IN2}$-2 and for conveying the secondary sixth current I6-2, and to the secondary feedback node 108-2 for receiving the secondary feedback voltage $V_{FB}$-2. The secondary second voltage-to-current converter 155-2 controls the secondary sixth current I6-2 dependent on the secondary feedback voltage $V_{FB}$-2 in all embodiments. The first and second connections 168, 170 and the secondary second connection 170-2 are separate, that is they provide independent current paths, enabling the voltage-to-current conversion performed by the secondary second voltage-to-current converter 155-2 to be independent of the voltage-to-current conversion performed by the converters 150, 155, but enabling linear superposition in the secondary second current I2-2 of the effects of the voltage-to-current conversion performed by the first and secondary second voltage-to-current converters 150, 155-2. The first voltage-to-current converter 150 and the secondary second voltage-to-current converter 155-2 can have, for example, the internal architecture illustrated in FIG. 5.

In operation, the secondary second current mirror device 194-2 controls the secondary second current I2-2 to be a reflection of the secondary sixth current I6-2. Therefore, changes in the secondary sixth current I6-2 introduced by the secondary second voltage-to-current converter 155-2 in response to changes in the secondary feedback voltage $V_{FB}$-2 are reflected in the secondary second current I2-2 by the secondary second current mirror device 194-2. Similarly, control of the fifth current I5 by the first voltage-to-current converter 150 in response to the reference voltage $V_{REF}$ is reflected in the first current I1 and in the secondary second current I2-2 by the primary current mirror stage 130-2, where they can be linearly superimposed on changes in the secondary second current I2-2 due to changes in the secondary feedback voltage $V_{FB}$-2.

As in the embodiments described above, if the voltage at the sources of both mirror transistors changes, the output current is still the same (or at least nearly the same) due to the current mirrors. It will be noted that the two transistors of one current mirror (the ones with connected gates) must have the same source voltage (i.e., the same supply or ground). Because the V-I converters are connected to PMOS mirrors that in turn are driven by an NMOS mirror, both PMOS transistors 194 can have a slightly different source voltage than the pair of transistors 192. The voltage between the sources of the pair 192 and the sources of the pair 194 can differ, but not so much that the maximum voltage at their drains comes above their rated value. Compared to FIG. 17, more of a difference between $V_{IN1}$ and $V_{IN1}$-2 can be tolerated because the sources of transistor pair 194-2 and transistor MP-2 are connected to $V_{IN1}$-2. In this case, $V_{IN1}$-2 can be more than 100 mV different from $V_{IN1}$.

The first secondary current mirror device 192 and the secondary second current mirror device 194-2 can operate with the same or different current mirror ratios, which can be the same as, or different from, the current mirror ratio of the primary current mirror stage 130-2. Under quiescent conditions when the secondary output voltage $V_{OUT}$-2 is at a target voltage value, the current bridge formed by the primary current mirror stage 130-2, the first and secondary second current paths 160, 162-2, and the first and secondary second voltage-to-current converters 150, 155-2 via the intermediary of the secondary second current mirror stage 194-2, is in balance. As in the case of the other embodiments described, any deviation of the secondary output voltage $V_{OUT}$-2 from the target voltage value will result in a change to the secondary feedback voltage $V_{FB}$-2 and to the first and secondary second currents I1, I2-2, such that the voltage in the secondary second current path 162-2 operates to control the secondary output transistor stage 110-2 to cause the secondary output voltage $V_{OUT}$-2 to be restored to the target voltage value.

Other variations and modifications will be apparent to the skilled person. Such variations and modifications may involve equivalent and other features which are already known and which may be used instead of, or in addition to, features described herein. Features that are described in the context of separate embodiments may be provided in combination in a single embodiment. Conversely, features which are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

What is claimed is:

1. A voltage regulator, comprising:

a first input for a first input voltage;

a second input for a second input voltage lower than the first input voltage;

an output for an output voltage;

an output transistor stage having a first terminal coupled to a first one of the first and second inputs, a second terminal coupled to the output, and a control terminal for controlling the conductivity of the output transistor stage between the first terminal and the second terminal;

a feedback network coupled to the output and a second one of the first and second inputs, being different from the first one of the first and second inputs, and arranged to produce at a feedback node a feedback voltage dependent on the output voltage;

a first current path for conveying a first current and a second current path for conveying a second current;

a primary current mirror stage coupled to the first current path and to the second current path and arranged to control the second current dependent on the first current;

a first voltage-to-current converter coupled to the first current path and arranged to control the first current dependent on one of the feedback voltage and a reference voltage, and a second voltage-to-current converter coupled to the second current path and arranged to control the second current dependent on the other of the feedback voltage and the reference voltage, wherein the voltage-to-current conversion provided by the first voltage-to-current converter is independent of the voltage-to-current conversion provided by the second voltage-to-current converter;

wherein the control terminal is coupled to the second current path for controlling the conductivity of the output transistor stage dependent on a voltage in the second current path indicative of a deviation of the second current from a target current value dependent on the reference voltage for thereby reducing a deviation of the output voltage from a target voltage value.

2. The voltage regulator of claim 1, wherein:

the first voltage-to-current converter comprises a first transconductance amplifier having a first transconductance amplifier first input coupled to the second one of the first and second inputs via a first current sensing resistive element, a first transconductance amplifier second input arranged to receive the one of the feedback voltage and the reference voltage, and a first transconductance amplifier output coupled to control the conductivity of a first current converter transistor dependent on a difference between a voltage at the first transconductance amplifier first input and a voltage at the first transconductance amplifier second input, wherein the first current converter transistor is arranged to control the first current in the first current path; and the second voltage-to-current converter comprises a second transconductance amplifier having a second transconductance amplifier first input coupled to the second one of the first and second inputs via a second current sensing resistive element, a second transconductance amplifier second input arranged to receive the other of the feedback voltage and the reference voltage, and a second transconductance amplifier output coupled to control the conductivity of a second current converter transistor dependent on a difference between a voltage at the second transconductance amplifier first input and a voltage at the second transconductance amplifier second input, wherein the second current converter transistor is arranged to control the second current in the second current path.

3. The voltage regulator of claim 2, wherein:

the one of the first and second inputs is the first input and the other of the first and second inputs is the second input; and the output transistor stage comprises an output transistor having a p-channel, a source coupled to the first terminal, a drain coupled to the second terminal and a gate coupled to the control terminal.

4. The voltage regulator of claim 2, wherein:

the one of the first and second inputs is the first input and the other of the first and second inputs is the second input; and the output transistor stage comprises an output transistor having an n-channel, a drain coupled to the first terminal, a source coupled to the second terminal and a gate coupled to the control terminal.

5. The voltage regulator of claim 2, wherein:

the one of the first and second inputs is the second input and the other of the first and second inputs is the first input; and the output transistor stage comprises an output transistor having an n-channel, a source coupled to the first terminal, a drain coupled to the second terminal and a gate coupled to the control terminal.

6. The voltage regulator of claim 2, wherein:

the one of the first and second inputs is the second input and the other of the first and second inputs is the first input;

the output transistor stage comprises an output transistor having a p-channel, a drain coupled to the first terminal, a source coupled to the second terminal and a gate coupled to the control terminal.

7. The voltage regulator of claim 3, wherein:

the first and second current converter transistors each comprise an n-channel;

the first transconductance amplifier first input and the second transconductance amplifier first input are inverting inputs; and the first transconductance amplifier second input and the second transconductance amplifier second input are non-inverting inputs.

8. The voltage regulator of claim 5, wherein:

the first and second current converter transistors each comprise a p-channel;

the first transconductance amplifier first input and the second transconductance amplifier first input are inverting inputs; and the first transconductance amplifier second input and the second transconductance amplifier second input are non-inverting inputs.

9. The voltage regulator of claim 2, wherein the first current sensing resistive element and the first current converter transistor are arranged in the first current path and the second current sensing resistive element and the second current converter transistor are arranged in the second current path.

10. The voltage regulator of claim 2, comprising:

a first secondary current mirror stage coupled between the first current path and the first voltage-to-current converter for controlling the first current dependent on a reflection of a current in the first voltage-to-current converter; and a second secondary current mirror stage coupled between the second current path and the second voltage-to-current converter for controlling the second current dependent on a reflection of a current in the second voltage-to-current converter.

11. The voltage regulator of claim 10, wherein:

the first current path comprises a plurality of first current sub-paths for each conveying a proportion of the first current;

the second current path comprises a plurality of second current sub-paths for each conveying a proportion of the second current;

the primary current mirror stage comprises a plurality of primary current mirror devices;

the first secondary current mirror stage comprises a plurality of first secondary current mirror devices coupled to respective ones of the primary current mirror device via the respective first current sub-paths;

the second secondary current mirror stage comprises a plurality of second secondary current mirror devices coupled to respective ones of the primary current mirror devices via the respective second current sub-paths; and the output transistor stage comprises a plurality of output transistors coupled between the first one of the first and second inputs and the output, wherein each of the output transistors is coupled to a different one of the second current sub-paths for controlling the conductivity of the respective output transistor between the first one of the first and second inputs and the output dependent on a voltage in the respective second current sub-path.

12. The voltage regulator of claim 1, wherein the primary current mirror stage is arranged to control the second current to be equal to the first current.

13. The voltage regulator of claim 1, wherein the primary current mirror stage is arranged to control the second current to be greater than the first current.

14. The voltage regulator of claim 1, further comprising a differential amplifier stage coupled to the primary current mirror stage by a third current path for conveying a third current and by a fourth current path for conveying a fourth current, and coupled to the feedback network for receiving the feedback voltage;

wherein the differential amplifier stage is arranged to control the third current dependent on the one of the feedback voltage and the reference voltage and to control the fourth current dependent on the other of the feedback voltage and the reference voltage; and the primary current mirror stage is arranged to control the fourth current dependent on the third current.

15. The voltage regulator of claim 14, wherein the differential amplifier stage is arranged to control the third current to be smaller than the first current and the fourth current to be smaller than the second current.

16. The voltage regulator of claim 1, further comprising a capacitive element coupled between the output and the feedback node.

17. The voltage regulator of claim 1, comprising a capacitive element coupled between the output and one of the first and second inputs.

18. The voltage regulator of claim 1, formed in an integrated circuit.

19. An electronic apparatus, comprising the voltage regulator as claimed in claim 1.

20. A method of regulating an output voltage, comprising:

producing a feedback voltage dependent on the output voltage;

controlling a first current in a first current path dependent on one of the feedback voltage and a reference voltage by a first voltage-to-current converter;

controlling a second current in a second current path dependent on the first current by a primary current mirror stage and controlling the second current dependent on the other of the feedback voltage and the reference voltage by a second voltage-to-current converter, wherein the voltage-to-current conversion provided by the first voltage-to-current converter is independent of the voltage-to-current conversion provided by the second voltage-to-current converter; and reducing a deviation of the output voltage from a target voltage value by controlling the output voltage dependent on a voltage in the second current path indicative of a deviation of the second current from a target current value dependent on the reference voltage.

21. A voltage regulator, comprising:

a plurality of first inputs for a respective plurality of first input voltages;

a plurality of second inputs for a respective plurality of second input voltages lower than the first input voltages;

a plurality of outputs for respective ones of a plurality of output voltages;

a plurality of output transistor stages, each output transistor stage having a first terminal coupled to a first one of either the plurality of first inputs or the plurality of second inputs, a second terminal coupled to an output, and a control terminal for controlling a conductivity of the output transistor stage between the first terminal and the second terminal;

a plurality of feedback networks, each feedback network being coupled to a respective output and a second one of either the plurality of first inputs or the plurality of second inputs, the second one being one of a plurality of inputs different from the first one's plurality of inputs, and configured for producing at a respective feedback node a respective feedback voltage dependent on a respective output voltage;

a first current path for conveying a first current, and a plurality of second current paths for conveying a respective plurality of second currents;

a primary current mirror stage coupled to the first current path and to the plurality of second current paths and configured for controlling the plurality of second currents dependent on the first current;

a first voltage-to-current converter coupled to the first current path and configured for controlling the first current dependent on a reference voltage; and a plurality of second voltage-to-current converters, each second voltage-to-current converter coupled to a respective one of the second current paths and configured for controlling a respective second current dependent on a respective feedback voltage;

wherein voltage-to-current conversion provided by the first voltage-to-current converter is independent of voltage-to-current conversion provided by the second voltage-to-current converters; and a control terminal of each output transistor stage is coupled to a respective second current path for controlling conductivity of the output transistor stage dependent on a voltage in the respective second current path indicative of a deviation of the respective second current from a target current value dependent on the reference voltage, thereby reducing a deviation of the respective output voltage from a target voltage value.

22. The voltage regulator of claim 21, wherein:

the first voltage-to-current converter comprises a first transconductance amplifier having a first transconductance amplifier first input coupled to a first input or to a second input via a first current sensing resistive element, a first transconductance amplifier second input arranged to receive the reference voltage, and a first transconductance amplifier output coupled to control a conductivity of a first current converter transistor dependent on a difference between a voltage at the first transconductance amplifier first input and a voltage at the first transconductance amplifier second input, wherein the first current converter transistor is arranged to control the first current in the first current path; and each second voltage-to-current converter comprises a second transconductance amplifier having a second transconductance amplifier first input coupled to a respective first input or to a respective second input via a second current sensing resistive element, a second transconductance amplifier second input arranged to receive a respective feedback voltage, and a second transconductance amplifier output coupled to control a conductivity of a second current converter transistor dependent on a difference between a voltage at the second transconductance amplifier first input and a voltage at the second transconductance amplifier second input, wherein the second current converter transistor is arranged to control a respective second current in a respective second current path.

23. The voltage regulator of claim 22, further comprising:

a first secondary current mirror stage coupled between the first current path and the first voltage-to-current converter for controlling the first current dependent on a reflection of a current in the first voltage-to-current converter; and a plurality of second secondary current mirror stages, each second secondary current mirror stage being coupled between a respective second current path and the respective second voltage-to-current converter for controlling the respective second current dependent on a reflection of a current in the respective second voltage-to-current converter.

24. The voltage regulator of claim 21, wherein at least two of the plurality of first input voltages differ from each other, or at least two of the plurality of second input voltages differ from each other.

* * * * *